US011605353B2

(12) United States Patent
Sang et al.

(10) Patent No.: US 11,605,353 B2
(45) Date of Patent: Mar. 14, 2023

(54) DISPLAY DRIVER AND DISPLAY DEVICE USING THE SAME

(71) Applicant: LG Display Co., Ltd., Seoul (KR)

(72) Inventors: WooKyu Sang, Paju-si (KR); HyoungSik Kim, Paju-si (KR); Dongkyu Lee, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/401,196

(22) Filed: Aug. 12, 2021

(65) Prior Publication Data

US 2022/0059036 A1 Feb. 24, 2022

(30) Foreign Application Priority Data

Aug. 18, 2020 (KR) ..... 10-2020-0103548

(51) Int. Cl.
*G09G 3/3275* (2016.01)
*G09G 3/3266* (2016.01)
*G09G 3/3233* (2016.01)

(52) U.S. Cl.
CPC ..... *G09G 3/3275* (2013.01); *G09G 3/3233* (2013.01); *G09G 3/3266* (2013.01); *G09G 2300/0842* (2013.01); *G09G 2310/08* (2013.01); *G09G 2330/028* (2013.01); *G09G 2360/16* (2013.01)

(58) Field of Classification Search
None
See application file for complete search history.

(56) References Cited

U.S. PATENT DOCUMENTS

2008/0170087 A1* 7/2008 Kim ..... G09G 3/3611 345/213
2011/0084992 A1* 4/2011 Ishizuka ..... G09G 3/3233 345/690
2015/0138249 A1* 5/2015 Miyata ..... G09G 3/3614 345/89
2021/0110775 A1* 4/2021 Wang ..... G09G 5/10
2021/0327368 A1* 10/2021 Park ..... H01L 27/3262

* cited by examiner

*Primary Examiner* — Nitin Patel
*Assistant Examiner* — Amen W Bogale
(74) *Attorney, Agent, or Firm* — Fenwick & West LLP

(57) ABSTRACT

The present disclosure relates to a display driver and a display device using the same. The display device according to the embodiment improves an effect of preventing leakage current of a data supply transistor by adaptively controlling and supplying, on the basis of a luminance value of an input data, a parking voltage which is applied in order to prevent the leakage current of the data supply transistor. The display driver comprises a controller which provides a clock signal swinging between a high level and a low level during a refresh frame in which a data voltage is written in a pixel, and provides a clock signal having a direct current voltage during a hold frame in which the data voltage written in the pixel is maintained; a data driver which supplies the data voltage to the pixel during the refresh frame in accordance with a data control signal of the controller; and a power supplier which supplies a parking voltage to the pixel during the hold frame.

19 Claims, 21 Drawing Sheets

DISPLAY DRIVER AND DISPLAY DEVICE USING THE SAME

CROSS-REFERENCE TO RELATED APPLICATIONS

This application claims the benefit of Korean Patent Application No. 10-2020-0103548 filed on Aug. 18, 2020, the entire contents of which is incorporated herein by reference for all purposes as if fully set forth herein.

BACKGROUND

Field

The present disclosure relates to a display driver and a display device using the same. In particular, the present disclosure relates to an electroluminescent display device using a variable refresh rate (VRR) mode, and is designed to improve the effect of preventing leakage current of a data supply transistor by adaptively controlling and supplying, on the basis of a luminance value of an input data, a parking voltage which is applied in order to prevent the leakage current of the data supply transistor.

Description of the Related Art

An electroluminescent display device which uses an electroluminescent device such as an organic light emitting diode may be driven by various driving frequencies.

Recently, as one of various functions required for the display device, a variable refresh rate (VRR) is also required. The VRR is a technology that drives a display device at a constant frequency and activates pixels by increasing the refresh rate when high-speed driving is required, and activates pixels by reducing the refresh rate when it is necessary to reduce power consumption or low-speed driving is required.

When the display device is driven in the VRR mode, the display device can be driven in a combination of a refresh frame and a hold frame. While, in the refresh frame, a new data voltage Vdata is charged and applied to a gate electrode of a driving transistor DT, in the hold frame, the data voltage Vdata of the previous frame is maintained and used as it is.

Meanwhile, in the hold frame section, the data voltage Vdata of the previous frame is maintained and used as it is, and a new data voltage Vdata is not applied. Therefore, the data supply transistor that provides a data signal to the driving transistor maintains the off-state for a long time. Leakage current may occur due to an electric potential difference between a source electrode and a drain electrode of the data supply transistor, during a period of time when the data supply transistor maintains the off-state for a long time. The leakage current causes a change in a gate-source voltage difference of the driving transistor, and as a result, a driving current of an electroluminescent device varies during the hold frame section, resulting in the deterioration of an image quality.

SUMMARY

The present disclosure relates to an electroluminescent display device using a variable refresh rate (VRR) mode, and is designed to improve the effect of preventing leakage current of a data supply transistor by adaptively controlling and supplying, on the basis of a luminance value of an input data, a parking voltage which is applied in order to prevent the leakage current of the data supply transistor.

The present disclosure provides a means for solving the above-mentioned problems and has the following embodiments.

One embodiment is a display driver including: a controller which provides a clock signal swinging between a high level and a low level during a refresh frame in which a data voltage is written in a pixel, and provides a clock signal having a direct current voltage during a hold frame in which the data voltage written in the pixel is maintained; a data driver which supplies the data voltage to the pixel during the refresh frame in accordance with a data control signal of the controller; and a power supplier which supplies a parking voltage to the pixel during the hold frame.

The power supplier generates the parking voltage on the basis of a current luminance which the controller outputs. The controller outputs the current luminance on the basis of an average picture level of an input image.

The controller includes a maximum luminance for each band and outputs the current luminance.

The power supplier includes a register in which the parking voltage mapped to the current luminance is stored.

The power supplier includes a register in which the parking voltage mapped to a maximum luminance for each band is stored in advance.

Another embodiment is a display device including: a display panel which includes an electroluminescent device and a pixel circuit connected to the electroluminescent device; a gate driver which provides a gate signal to the display panel; a data driver which supplies a data voltage to the display panel during a refresh frame; a controller which provides the gate driver with a clock signal swinging between a high level and a low level during the refresh frame in which the data voltage is supplied to the display panel, and provides the gate driver with a clock signal having a direct current voltage during a hold frame in which the data voltage written in the pixel circuit is maintained; and a power supplier which supplies a parking voltage to the pixel circuit during the hold frame.

The pixel circuit includes: a driving transistor which has a first electrode, a second electrode, and a gate electrode, and supplies a driving current to the electroluminescent device; and a data supply transistor configured to connect a data line to which the data voltage or the parking voltage is applied and the first electrode or the second electrode of the driving transistor, in accordance with a scan signal supplied from the controller.

The controller supplies the scan signal such that the data supply transistor performs an off-operation during the hold frame.

The display device further includes a switching element SW which is configured to connect the power supplier and the data line in accordance with a parking voltage enable signal Vpark_EN of the controller.

The controller outputs the parking voltage enable signal Vpark_EN such that the switching element SW performs an on-operation during the hold frame.

The power supplier generates the parking voltage on the basis of a current luminance which the controller outputs, and the controller outputs the current luminance on the basis of an average picture level of an input image.

The controller includes a maximum luminance for each band and outputs the current luminance.

The power supplier includes a register in which the parking voltage mapped to the current luminance is stored.

The power supplier includes a register in which the parking voltage mapped to a maximum luminance for each band is stored in advance.

The pixel circuit further includes a compensation transistor which is configured to connect the first electrode or the second electrode and the gate electrode of the driving transistor.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION

Figure 1:
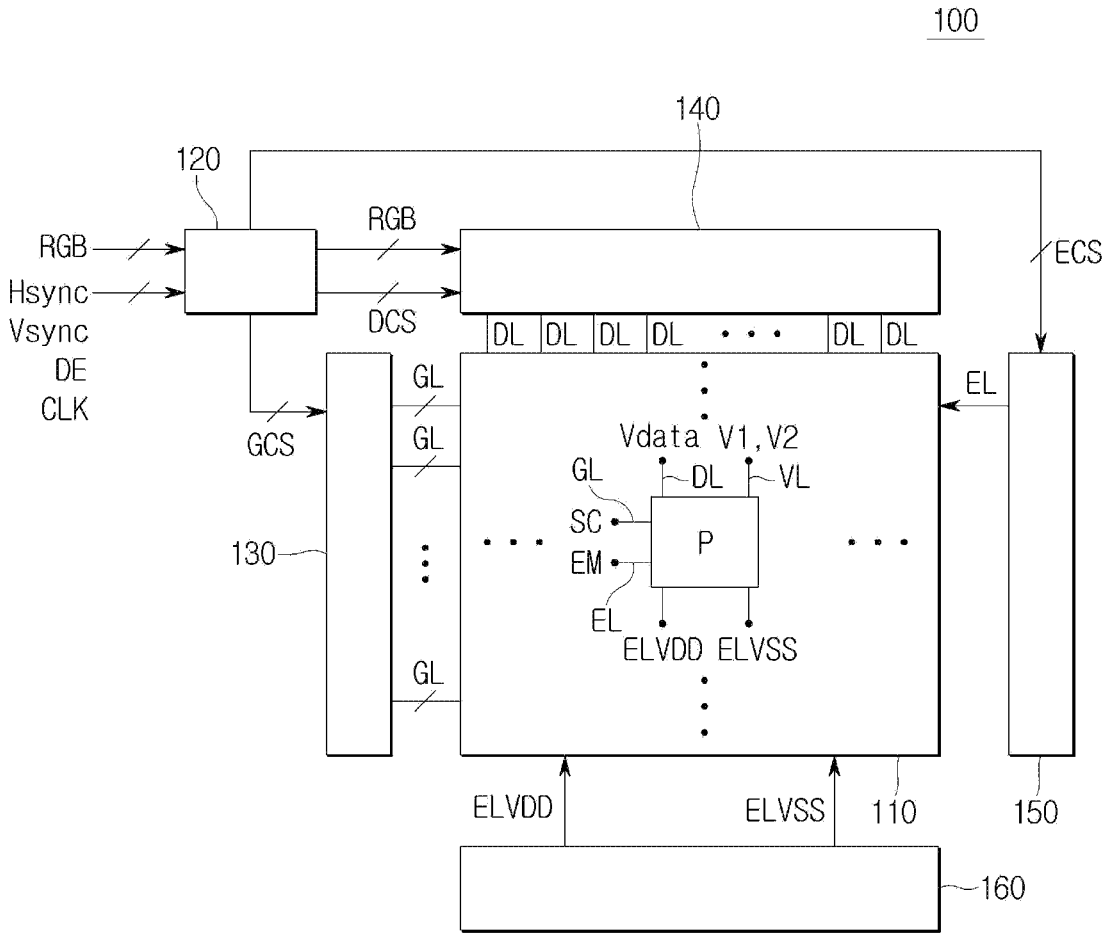
FIG. 1 is a block diagram showing schematically an electroluminescent display device according to an embodiment of the present invention.

The features, advantages and method for accomplishment of the present invention will be more apparent from referring to the following detailed embodiments described as well as the accompanying drawings. However, the present invention is not limited to the embodiment to be disclosed below and is implemented in different and various forms. The embodiments bring about the complete disclosure of the present invention and are only provided to make those skilled in the art fully understand the scope of the present invention. The present invention is just defined by the scope of the appended claims. The same reference numerals throughout the disclosure correspond to the same elements.

What one component is referred to as being "connected to" or "coupled to" another component includes both a case where one component is directly connected or coupled to another component and a case where a further another component is interposed between them. Meanwhile, what one component is referred to as being "directly connected to" or "directly coupled to" another component indicates that a further another component is not interposed between them. The term "and/or" includes each of the mentioned items and one or more all of combinations thereof.

Terms used in the present specification are provided for description of only specific embodiments of the present invention, and not intended to be limiting. In the present specification, an expression of a singular form includes the expression of plural form thereof if not specifically stated. The terms "comprises" and/or "comprising" used in the specification is intended to specify characteristics, numbers, steps, operations, components, parts or any combination thereof which are mentioned in the specification, and intended not to exclude the existence or addition of at least one another characteristics, numbers, steps, operations, components, parts or any combination thereof.

While terms such as the first and the second, etc., can be used to describe various components, the components are not limited by the terms mentioned above. The terms are used only for distinguishing between one component and other components.

Therefore, the first component to be described below may be the second component within the spirit of the present invention. Unless differently defined, all terms used herein including technical and scientific terms have the same meaning as commonly understood by one of ordinary skill in the art to which the present invention belongs. Also, commonly used terms defined in the dictionary should not be ideally or excessively construed as long as the terms are not clearly and specifically defined in the present application.

The term "module" or "part" used in this specification may mean software components or hardware components such as a field programmable gate array (FPGA), an application specific integrated circuit (ASIC). The "part" or "module" performs certain functions. However, the "part" or "module" is not meant to be limited to software or hardware. The "part" or "module" may be configured to be placed in an addressable storage medium or to restore one or more processors. Thus, for one example, the "part" or "module" may include components such as software components, object-oriented software components, class components, and task components, and may include processes, functions, attributes, procedures, subroutines, segments of a program code, drivers, firmware, microcode, circuits, data, databases, data structures, tables, arrays, and variables. Components and functions provided in the "part" or "module" may be combined with a smaller number of components and "parts" or "modules" or may be further divided into additional components and "parts" or "modules".

Methods or algorithm steps described relative to some embodiments of the present disclosure may be directly implemented by hardware or software modules that are executed by a processor or may be directly implemented by a combination thereof. The software module may be resident on a RAM, a flash memory, a ROM, an EPROM, an EEPROM, a register, a hard disk, a removable disk, a CD-ROM, or any other type of record medium known to those skilled in the art. An exemplary record medium is coupled to a processor and the processor can read information from the record medium and can record the information in a storage medium. In another way, the record medium may be integrally formed with the processor. The processor and the record medium may be resident within an application specific integrated circuit (ASIC). The ASIC may be resident within a user's terminal.

FIG. 1 is a block diagram showing schematically an electroluminescent display device according to the embodiment of the present invention.

Referring to FIG. 1, the electroluminescent display device 100 includes a display panel 110 including a plurality of pixels, a gate driver 130 supplying a gate signal to each of the plurality of pixels, and a data driver 140 supplying a data signal to each of the plurality of pixels, a light emission signal generator 150 supplying a light emission signal to each of the plurality of pixels, a power supplier 160 supplying a first power supply voltage ELVDD and a second power supply voltage ELVSS to each of the plurality of pixels, and a controller 120. The first power supply voltage ELVDD may be a higher potential voltage than the second power supply voltage ELVSS. The controller 120, the data driver 140 and the power supplier 160 may constitute a display driver of the present invention.

The controller 120 processes an image data RGB input from the outside appropriately for the size and resolution of the display panel 110 and provides it to the data driver 140. The controller 120 generates a plurality of gate control signals GCS, a plurality of data control signals DCS, and a plurality of light emission control signals ECS by using synchronization signals (SYNC) input from the outside, for example, a dot clock signal CLK, a data-enable signal DE, a horizontal synchronization signal Hsync, and a vertical synchronization signal Vsync. By providing the plurality of generated gate, data, and light emission control signals GCS, DCS, and ECS to the gate driver 130, the data driver 140, and the light emission signal generator 150, respectively, the controller 120 controls the gate driver 130, the data driver 140, and the light emission signal generator 150.

The controller 120 may be coupled to various processors, for example, a microprocessor, a mobile processor, an application processor, etc., according to a mounted device.

The controller 120 generates a signal such that the pixel can be driven at various refresh rates. That is, the controller 120 generates signals related to driving such that the pixels are driven in a variable refresh rate (VRR) mode or driven to be switchable between a first refresh rate and a second refresh rate. For example, the controller 120 simply changes the speed of a clock signal, generates a synchronization signal to generate a horizontal blank or a vertical blank, or drives the gate driver 130 in a mask method, thereby driving the pixel at various refresh rates.

Also, the controller 120 generates various signals for driving a pixel driving circuit at the first refresh rate. Particularly, when the pixel driving circuit is driven at the first refresh rate, the controller 120 generates the light emission control signal ECS in order that the light emission signal generator 150 generates a light emission signal EM having a first duty ratio. Then, the controller 120 operates to drive the pixel driving circuit at the second refresh rate, and, to this end, generates various signals for driving at the second refresh rate. In particular, when the pixel driving circuit is driven at the second refresh rate, the controller 120 generates the light emission control signal ECS in order that the light emission signal generator 150 generates the light emission signal EM having a second duty ratio different from the first duty ratio.

In the embodiment, the controller 120 may provide the gate driver 130 with a gate clock signal which swings between a high level and a low level during a refresh frame in which a data voltage is written in the pixel, and may provide the gate driver 130 with a gate clock signal which has a direct current voltage during a hold frame in which the data voltage written in the pixel is maintained.

The gate driver 130 provides scan signals SC to gate lines GL in accordance with the gate control signal GCS provided from the controller 120. In FIG. 1, the gate driver 130 is shown to be arranged apart from one side of the display panel 110. However, the number and arrangement position of the gate driver 130 are not limited thereto. That is, the gate driver 130 may be disposed on one side or both sides of the display panel 110 in a Gate In Panel (GIP) method.

The data driver 140 converts the image data RGB into a data voltage Vdata in accordance with the data control signal DCS provided from the controller 120, and supplies the converted data voltage Vdata to the pixel through a data line DL.

In the display panel 110, a plurality of gate lines GL, a plurality of light emission lines EL, and a plurality of data lines DL cross each other, and each of the plurality of pixels is connected to the gate line GL, the light emission line EL, and the data line DL. Specifically, one pixel receives the gate signal from the gate driver 130 through the gate line GL, receives the data signal from the data driver 140 through the data line DL, and receives the light emission signal EM through the light emission line EL, and receives various power through a power supply line. Here, the gate line GL provides the scan signal SC, the light emission lines EL provides the light emission signal EM, and the data line DL supplies the data voltage Vdata. However, according to various embodiments, the gate line GL may include a plurality of scan signal lines, and the data line DL may further include a plurality of power supply lines VL. Also, the light emission line EL may also include a plurality of light emission signal lines. Also, one pixel receives a high potential voltage ELVDD and a low potential voltage ELVSS. Also, one pixel may receive a first and a second bias voltage V1 and V2 through the plurality of power supply lines VL.

Further, each of the pixels includes an electroluminescent device and a pixel driving circuit that controls the driving of the electroluminescent device. Here, the electroluminescent device includes an anode, a cathode, and an organic light emitting layer between the anode and the cathode. The pixel driving circuit includes a plurality of switching elements SW (see FIG. 5), driving switching elements DT, and capacitors. Here, the switching element SW may be composed of a TFT. In the pixel driving circuit, a driving TFT controls the amount of current supplied to the electroluminescent device in accordance with a difference between a reference voltage and the data voltage charged in the capacitor, and controls the amount of light emission of the electroluminescent device. Also, a plurality of switching TFTs receive the scan signal SC supplied through the gate line GL and the light emission signal EM supplied through the light emission line EL, and charge the data voltage Vdata in the capacitor.

The electroluminescent display device 100 according to the embodiment of the present invention includes the gate driver 130, the data driver 140, and the light emission signal generator 150, which are for driving the display panel 110 including the plurality of pixels, and the controller 120 for controlling them. Here, the light emission signal generator 150 is configured to be able to control the duty ratio of the light emission signal EM. For example, the light emission signal generator 150 may include a shift register, a latch, etc., for controlling the duty ratio of the light emission signal EM. The light emission signal generator 150 may be configured to generate the light emission signal having the first duty ratio and to provide it to the pixel driving circuit, when the pixel driving circuit is driven at the first refresh rate in accordance with the light emission control signal ECS generated by the controller 120, and may be configured to generate the light emission signal having the second duty ratio different from the first duty ratio and to provide it to the pixel driving circuit, when the pixel driving circuit is driven at the second refresh rate.

Figure 2:
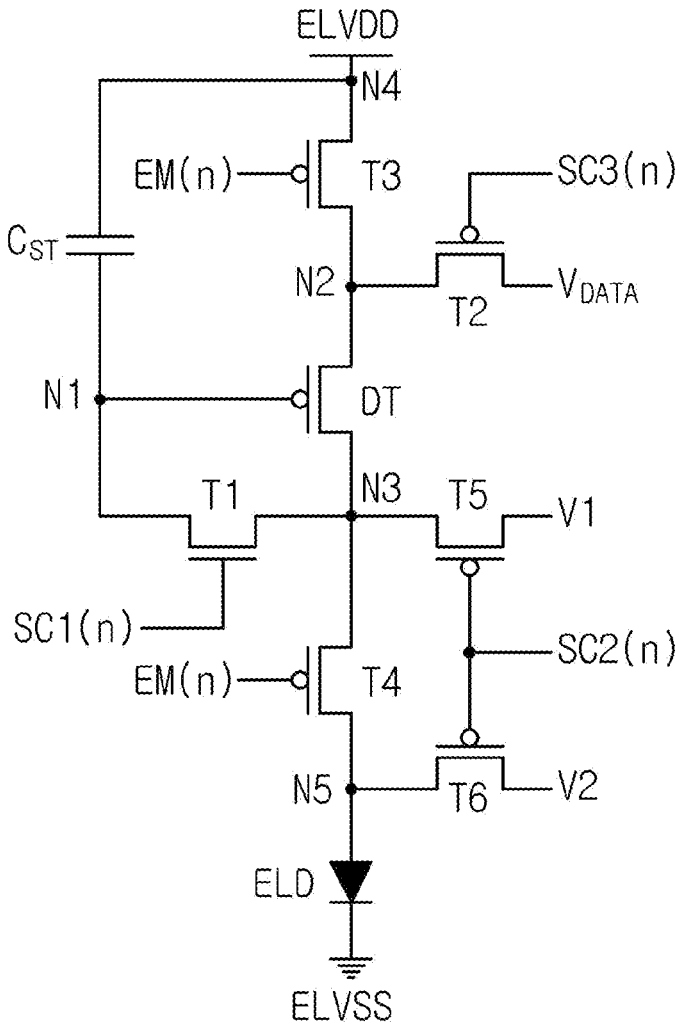
FIG. 2 is a circuit diagram of a pixel circuit of the electroluminescent display device according to the embodiment of the present invention.

FIG. 2 is a circuit diagram of a pixel circuit of the electroluminescent display device according to the embodiment of the present invention. FIG. 2 only illustratively shows the pixel driving circuit (or pixel circuit) for description, and there is no limitation as long as the pixel driving circuit has a structure which is provided with the light emission signal EM and is capable of controlling the light emission of the electroluminescent device ELD. For example, the pixel driving circuit may include an additional scan signal, a switching TFT connected to the scan signal, and a switching TFT to which an additional initialization voltage is applied. Also, a connection relationship between switching elements SW or a connection position of the capacitor may be variously arranged. That is, since the light emission of the electroluminescent device ELD is controlled according to the change in the duty ratio of the light emission signal EM, as long as the light emission can be controlled according to the refresh rate, the pixel driving circuit having various structures may be used. For example, various pixel driving circuits such as 3T1C, 4T1C, 6T1C, 7T1C, and 7T2C or the like may be used. Hereinafter, for convenience of description, the electroluminescent display device having a pixel driving circuit of 7T1C of FIG. 2 will be described.

Referring to FIG. 2, each of the plurality of pixels P may include a pixel circuit (PC) having a driving transistor DT, and the electroluminescent device ELD connected to the pixel circuit PC.

The pixel circuit (PC) may drive the electroluminescent device ELD by controlling a driving current (Id) flowing through the electroluminescent device ELD. The pixel circuit (PC) may include the driving transistor DT, first to sixth transistors T1 to T6, and a storage capacitor $C_{ST}$. Each of the transistors DT and T1 to T6 may include a first electrode, a second electrode, and a gate electrode. One of the first electrode and the second electrode may be a source electrode, and the other of the first electrode and the second electrode may be a drain electrode.

Each of the transistors DT and T1 to T6 may be a PMOS transistor or an NMOS transistor. Hereinafter, a case where the first transistor T1 is an NMOS transistor and the other transistors DT and T2 to T6 are PMOS transistors will be described as an example. Accordingly, the first transistor T1 is turned on by being applied with a high voltage, and the other transistors DT and T2 to T6 are turned on by being applied with a low voltage.

According to an example, the first transistor T1 constituting the pixel circuit (PC) may function as a compensation transistor, the second transistor T2 may function as a data supply transistor, the third and fourth transistors T3 and T4 may function as light emission control transistors, and the fifth and sixth transistors T5 and T6 may function as bias transistors.

The electroluminescent device ELD may include a pixel electrode (or an anode electrode) and a cathode electrode. The pixel electrode of the electroluminescent device ELD may be connected to a fifth node N5, and the cathode electrode may be connected to a second power supply voltage ELVSS.

The driving transistor DT may include the first electrode connected to a second node N2, the second electrode connected to a third node N3, and the gate electrode connected to a first node N1. The driving transistor DT may provide the driving current (Id) to the electroluminescent device ELD on the basis of the voltage of the first node N1 (or the data voltage stored in the capacitor $C_{ST}$ to be described later).

The first transistor T1 may include the first electrode connected to the first node N1, the second electrode connected to the third node N3, and the gate electrode which receives a first scan signal SC1(*n*). The first transistor T1 may be turned on in response to the first scan signal SC1(*n*) and may transmit the data voltage $V_{DATA}$ to the first node N1. The first transistor T1 is diode-connected between the first node N1 and the third node N3, thereby sampling a threshold voltage (Vth) of the driving transistor DT. The first transistor T1 may be a compensation transistor.

The capacitor $C_{ST}$ may be connected or formed between the first node N1 and a fourth node N4. The capacitor $C_{ST}$ may store or maintain the provided data voltage $V_{DATA}$.

The second transistor T2 may include the first electrode connected to the data line DL (or receiving the data voltage $V_{DATA}$), the second electrode connected to the second node N2, and the gate electrode which receives a third scan signal SC3(*n*). The second transistor T2 may be turned on in response to the third scan signal SC3(*n*) and may transmit the data voltage $V_{DATA}$ to the second node N2. The second transistor T2 may be a data supply transistor.

The third transistor T3 and the fourth transistor T4 (or the first and second light emission control transistors) may be connected between a first power supply voltage ELVDD and the electroluminescent device ELD, and may form a current moving path through which the driving current (Id) which is generated by the driving transistor DT moves.

The third transistor T3 may include the first electrode which is connected to the fourth node N4 and receives the first power supply voltage ELVDD, the second electrode which is connected to the second node N2, and the gate electrode which receives the light emission signal EM(n).

Similarly, the fourth transistor T4 may include the first electrode which is connected to the third node N3, the second electrode which is connected to the fifth node N5 (or the pixel electrode of the electroluminescent device ELD), and the gate electrode which receives the light emission signal EM(n).

The third and fourth transistors T3 and T4 are turned on in response to the light emission signal EM(n). In this case, the driving current (Id) is supplied to the electroluminescent device ELD, and the electroluminescent device ELD can emit light with a luminance corresponding to the driving current (Id).

The fifth transistor T5 includes the first electrode which is connected to the third node N3, the second electrode which receives the first bias voltage V1, and the gate electrode which receives a second scan signal SC2(*n*).

The sixth transistor T6 may include the first electrode which is connected to the fifth node N5, the second electrode which receives the second bias voltage V2, and the gate electrode which receives the second scan signal SC2(*n*). In FIG. 2, the gate electrodes of the fifth and sixth transistors T5 and T6 are configured to receive the second scan signal SC2(*n*) in common. However, the present invention is not necessarily limited thereto, and the gate electrodes of the fifth and sixth transistors T5 and T6 may be configured to receive separate scan signals and to be controlled independently, respectively.

The sixth transistor T6 may include the first electrode which is connected to the fifth node N5, the second electrode which is connected to the second bias voltage V2, and the gate electrode which receives the second scan signal SC2(*n*). Before the electroluminescent device ELD emits light (or after the electroluminescent device ELD emits light), the sixth transistor T6 may be turned on in response to the second scan signal SC2(*n*) and may initialize the pixel electrode (or anode electrode) of the electroluminescent device ELD by using the second bias voltage V2. The electroluminescent device ELD may have a parasitic capacitor formed between the pixel electrode and the cathode electrode. Also, while the electroluminescent device ELD emits light, the parasitic capacitor is charged so that the pixel electrode of the electroluminescent device ELD may have a specific voltage. Accordingly, by applying the second bias voltage V2 to the pixel electrode of the electroluminescent device ELD through the sixth transistor T6, the amount of charge accumulated in the electroluminescent device ELD can be initialized.

The present disclosure relates to the electroluminescent display device using a variable refresh rate (VRR) mode. The VRR is a technology that drives the display device at a constant frequency and activates pixels by increasing the refresh rate at which the data voltage $V_{DATA}$ is updated when high-speed driving is required, and drives pixels by reducing the refresh rate when it is necessary to reduce power consumption or low-speed driving is required.

Each of the plurality of pixels P may be driven through a combination of a refresh frame and a hold frame within one second. In this specification, one set is defined as that the refresh frame in which the data voltage $V_{DATA}$ is updated is repeated. Also, one set section is a cycle in which the refresh frame in which the data voltage $V_{DATA}$ is updated is repeated.

When the pixel is driven at the refresh rate of 120 Hz, the pixel can be driven only by the refresh frame. That is, the refresh frame can be driven 120 times within one second. One refresh frame section is 1/120=8.33 ms, and one set section is also 8.33 ms.

When the pixel is driven at the refresh rate of 60 Hz, the refresh frame and the hold frame may be alternately driven. That is, the refresh frame and the hold frame may be alternately driven 60 times within one second. One refresh frame section and one hold frame section are 0.5/60=8.33 ms, respectively, and one set section is 16.66 ms.

When the pixel is driven at the refresh rate of 1 Hz, one frame may be driven with one refresh frame and with 119 hold frames after the one refresh frame. One refresh frame section and one hold frame section are 1/120=8.33 ms, respectively, and one set section is 1 s.

FIGS. 3A to 3K are views for describing the driving of the electroluminescent device and the pixel circuit of a refresh frame in the pixel circuit of the display device shown in FIG. 2.

Figure 4A:
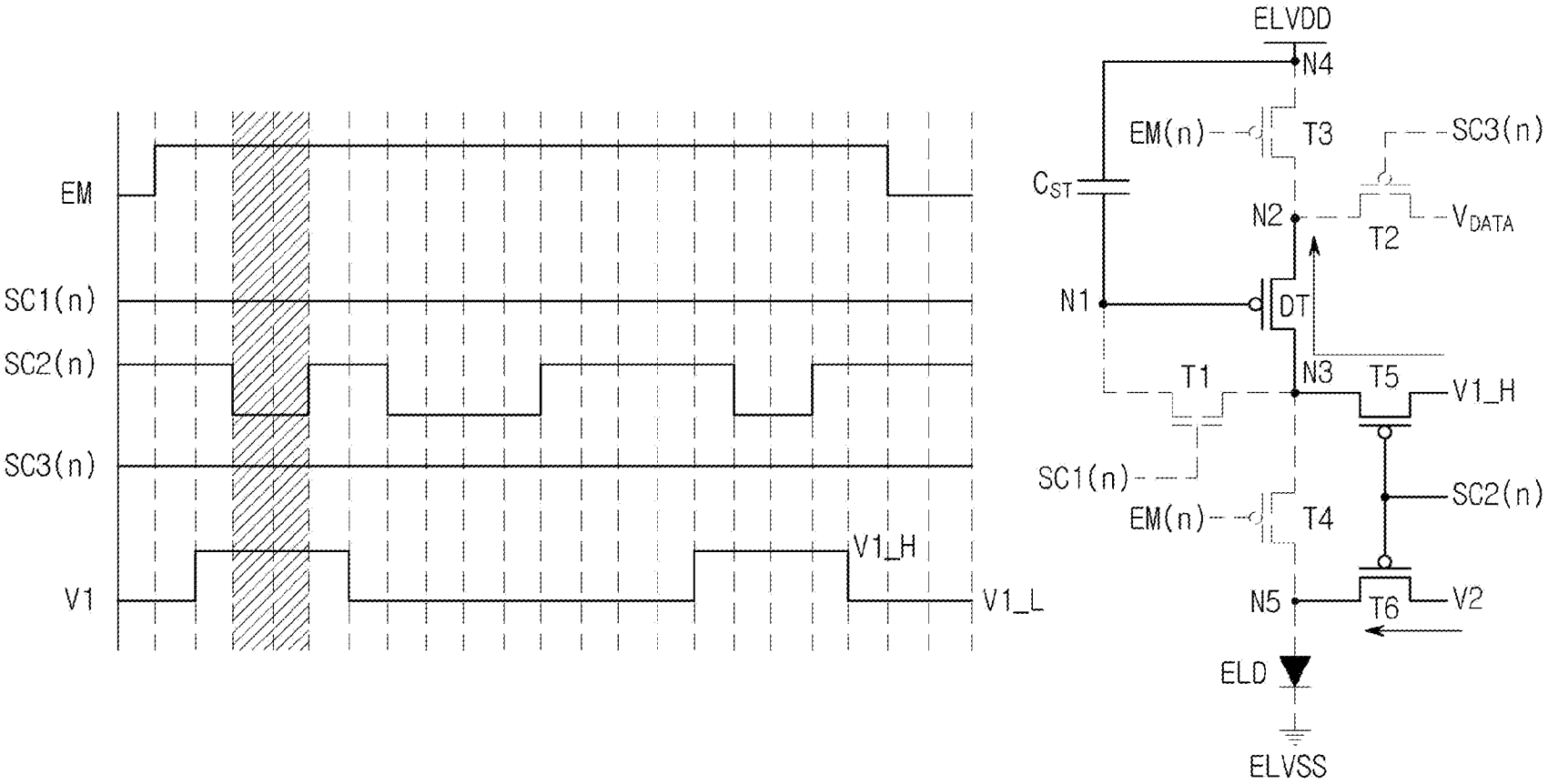
FIGS. 4A to 4C are views for describing the driving of the electroluminescent device and the pixel circuit of a hold frame in the pixel circuit of the display device shown in FIG. 2.
Figure 4B:
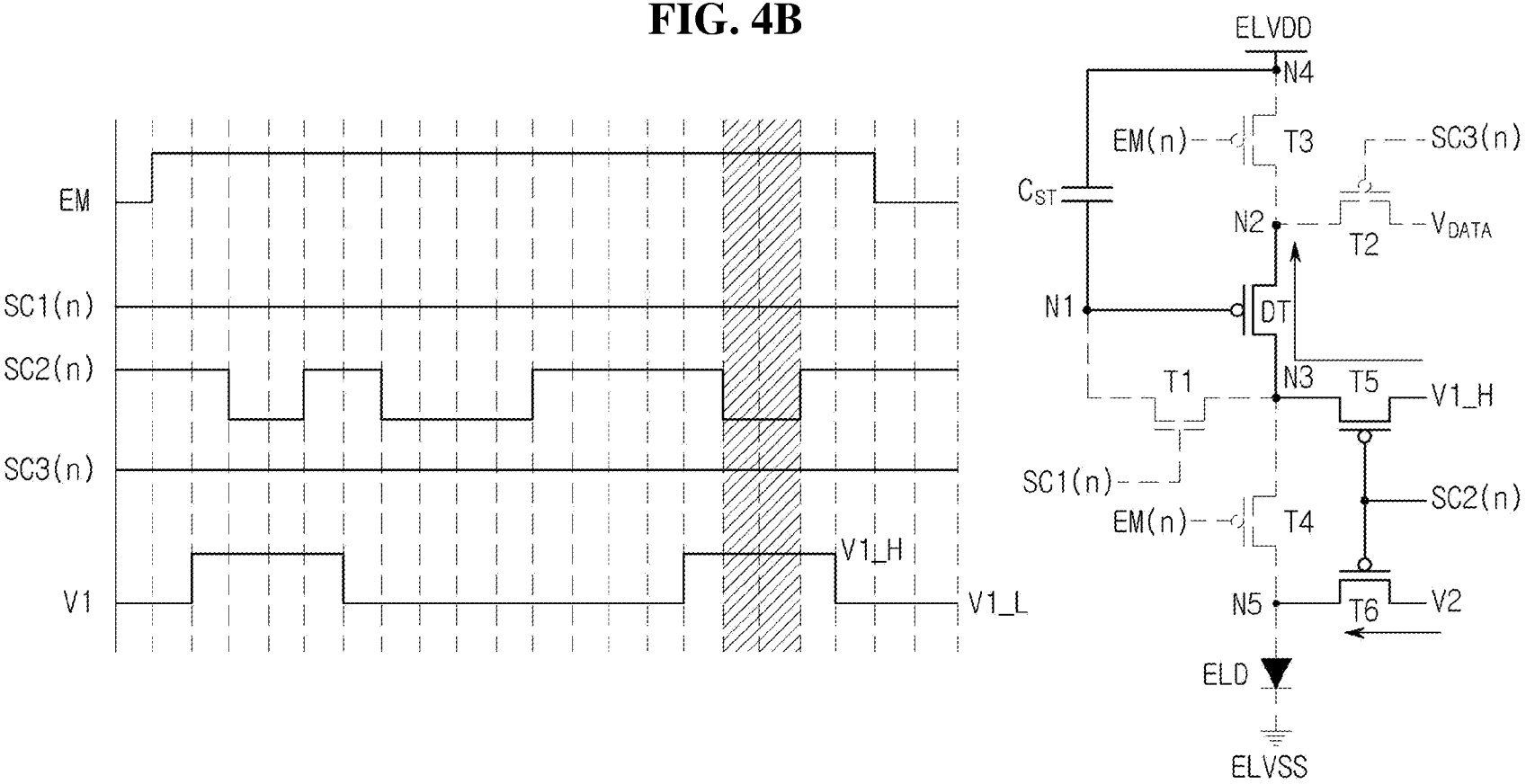
Figure 4C:
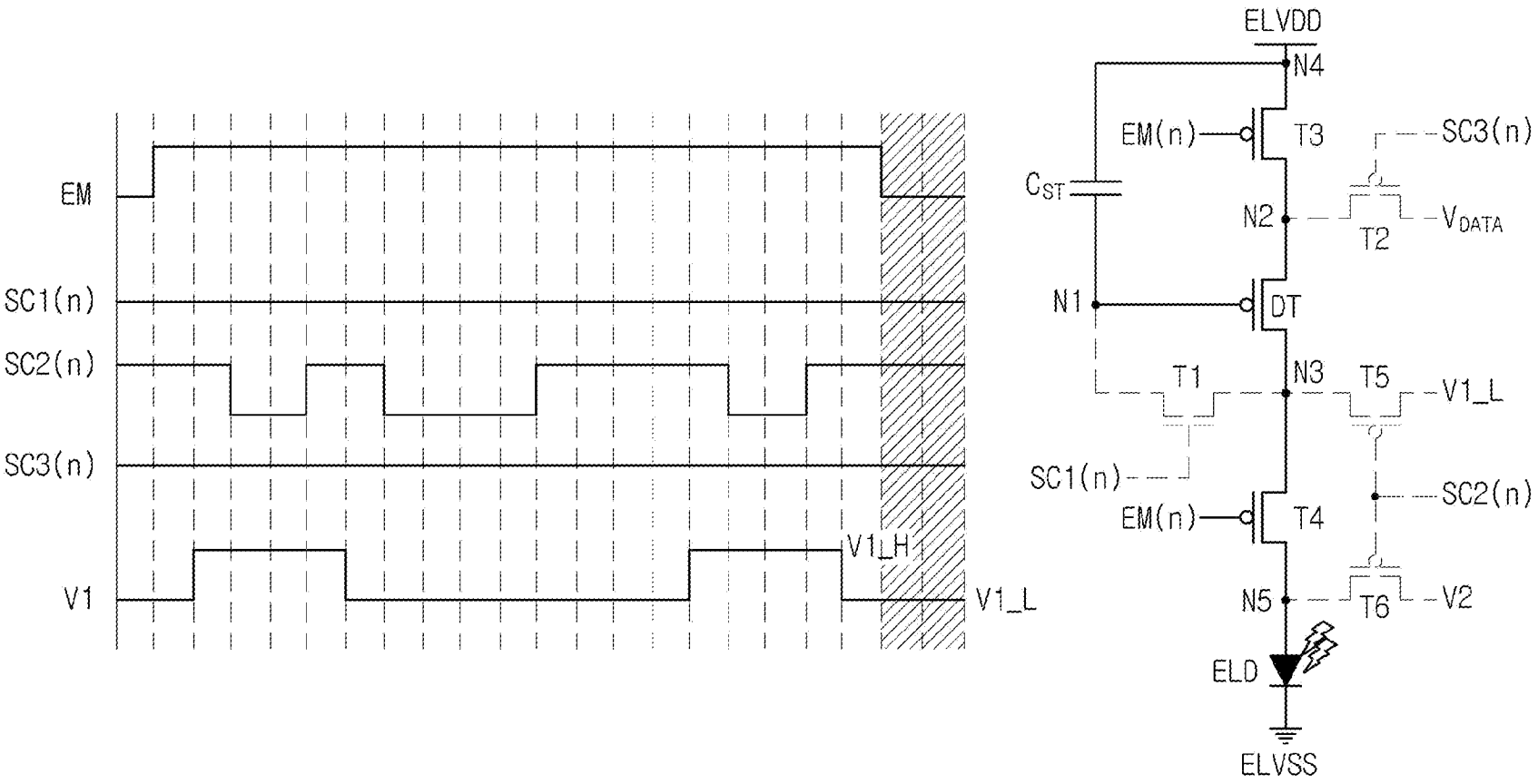

FIGS. 4A to 4C are views for describing the driving of the electroluminescent device and the pixel circuit of a hold frame in the pixel circuit of the display device shown in FIG. 2.

While, in the refresh frame, a new data voltage $V_{DATA}$ is charged and applied to the gate electrode of the driving transistor DT, in the hold frame, the data voltage $V_{DATA}$ of the previous frame is maintained and used. Meanwhile, the hold frame is also referred to as a skip frame in that the process of applying the new data voltage Vdata to the gate electrode of the driving transistor DT is omitted.

Each of the plurality of pixels P may initialize a voltage which is charged or remains in the pixel circuit (PC) during the refresh frame section. Specifically, each of the plurality of pixels P may remove the influence of the driving voltage (VDD) and the data voltage $V_{DATA}$ stored in the previous frame in the refresh frame. Accordingly, each of the plurality of pixels P may display an image corresponding to the new data voltage $V_{DATA}$ in the hold frame section.

Each of the plurality of pixels P may display the image by providing the driving current Id corresponding to the data voltage $V_{DATA}$ to the electroluminescent device ELD during the hold frame section, and may maintain the turn-on state of the electroluminescent device ELD.

First, the driving of the electroluminescent device and the pixel circuit of the refresh frame will be described with reference to FIGS. 3A to 3K. The refresh frame may operate including at least one bias section, an initialization section, a sampling section, and a light emission section. However, this is only an embodiment and is not necessarily limited to this order.

Figure 3A:
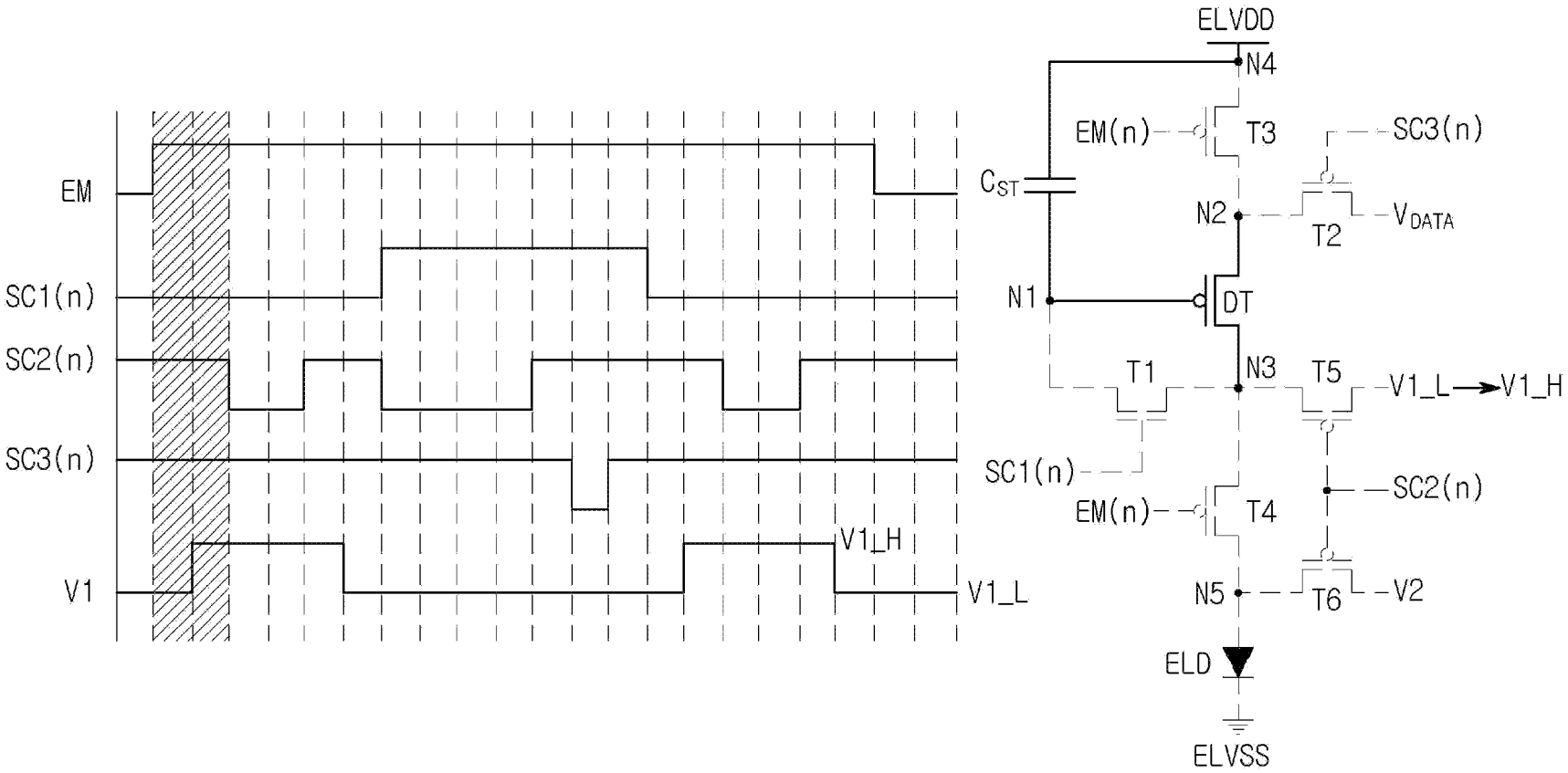
FIGS. 3A to 3K are views for describing the driving of an electroluminescent device and the pixel circuit of a refresh frame in the pixel circuit of the display device shown in FIG. 2.
Figure 3B:
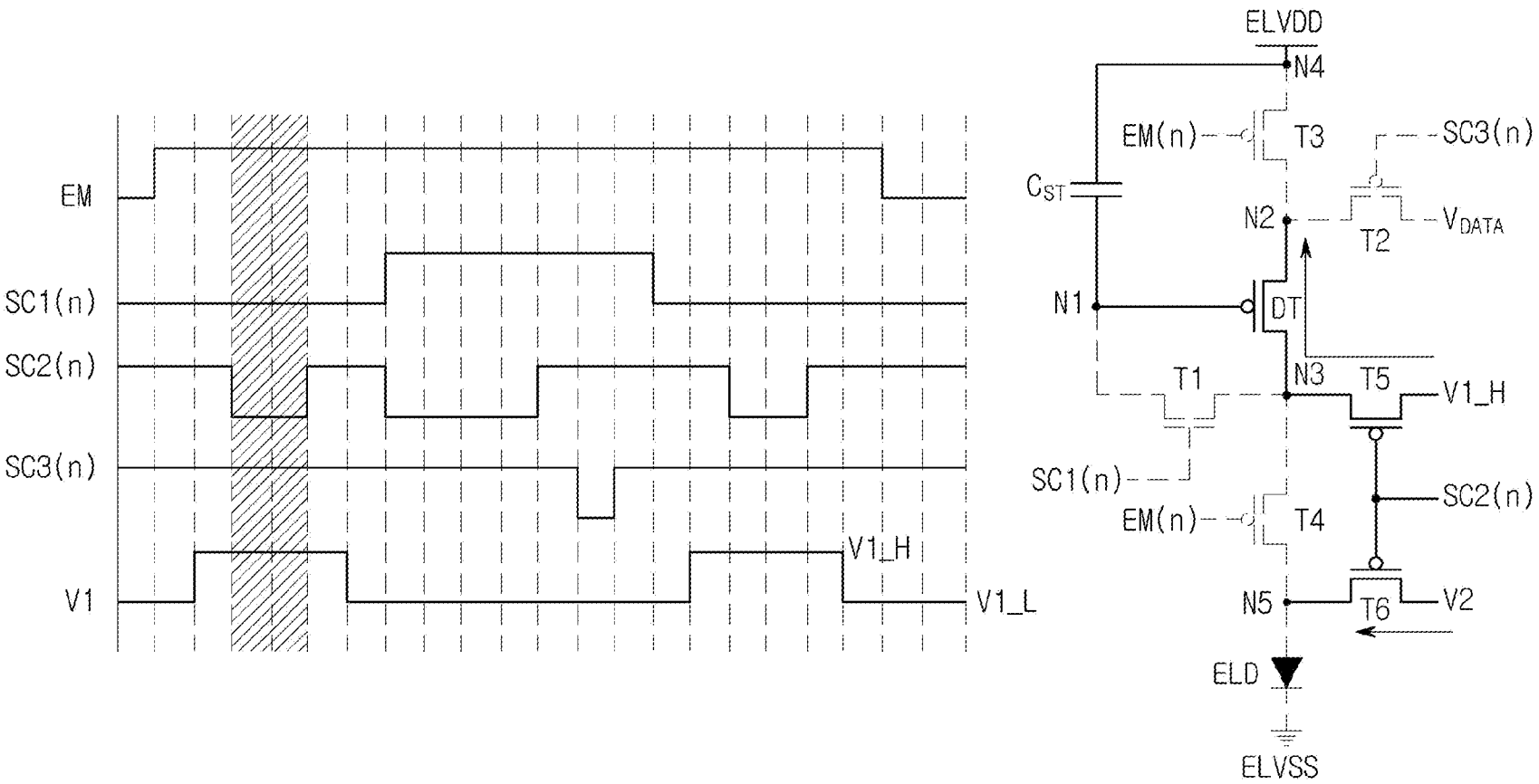
Figure 3C:
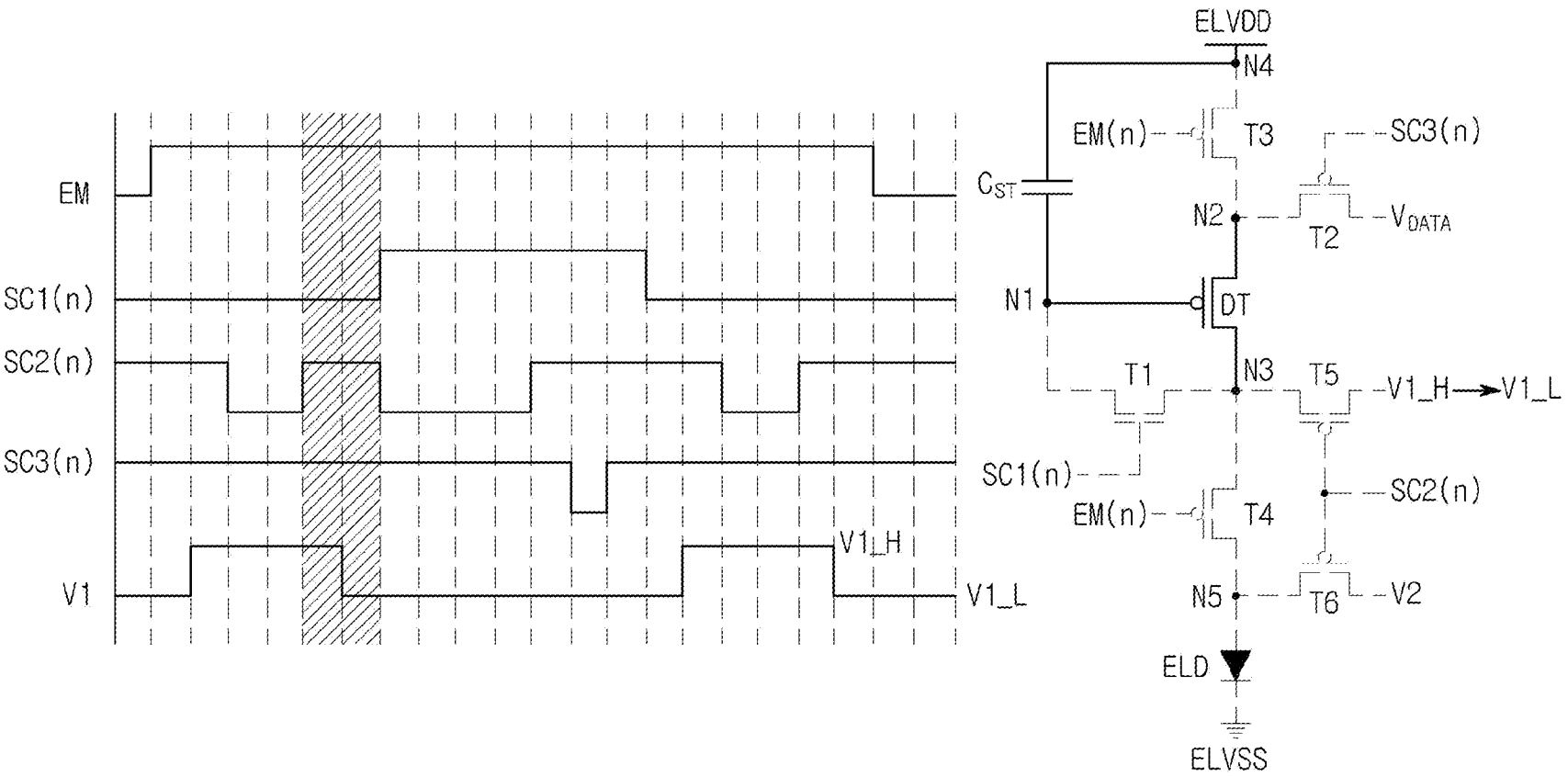

FIGS. 3A to 3C show a first bias section.

In FIG. 3A, a section in which the first bias voltage V1 is changed from a first voltage to a second voltage is shown. The light emission signal EM represents a high voltage, and the third and fourth transistors T3 and T4 are turned off. The first voltage is represented as V1_L, and the second voltage is represented as V1_H. The V1_H is higher than the V1_L, and it is preferable that the V1_H is higher than the data voltage $V_{DATA}$. The first scan signal SC1(*n*) is a low voltage and the first transistor T1 is turned off. The second and third scan signals SC2(*n*) and SC3(*n*) are high voltages, and the second, fifth, and sixth transistors T2, T5, and T6 are turned off. The voltage of the gate electrode of the driving transistor DT connected to the first node N1 is $V_{DATA}(n-1)-|Vth|$, that is, a difference between the data voltage $V_{DATA}(n-1)$ of the previous frame n−1 and the threshold voltage Vth of the driving transistor DT.

In FIG. 3B, the low second scan signal SC2(*n*) is input, and the fifth and sixth transistors T5 and T6 are turned on. As the fifth transistor T5 is turned on, the first bias voltage V1 (V1_H) is applied to the first electrode of the driving transistor DT connected to the second node N2. The voltage of the first electrode of the driving transistor DT connected to the second node N2 increases to the voltage V1_H. The driving transistor DT may be a PMOS transistor, and in this case, the first electrode may be a source electrode. Here, the voltage Vgs between the gate and the source of the driving transistor DT is $$Vgs=V_{DATA}(n-1)-|Vth|-V1_H.$$

Here, the first bias voltage V1=V1_H is supplied to the third node N3, that is the drain electrode of the driving transistor DT, so that the charging time or charging delay of the voltage of the fifth node N5 that is the anode electrode of the electroluminescent device ELD can be reduced in the light emission section. The driving transistor DT maintains a stronger saturation. For example, as the first bias voltage V1=V1_H increases, the voltage of the third node N3 that is the drain electrode of the driving transistor DT may increase and a gate-source voltage or a drain-source voltage of the driving transistor DT may decrease. Therefore, it is preferable that the first bias voltage V1_H is at least higher than the data voltage $V_{DATA}$. Here, the magnitude of the drain-source current (Id) passing through the driving transistor DT may be reduced, and the stress of the driving transistor DT is reduced in a positive bias stress situation, thereby eliminating the charging delay of the voltage of the third node N3. In other words, the Vgs of the driving transistor DT is biased to the $V_{DATA}$ before the threshold voltage Vth of the driving transistor DT is sampled, so that the hysteresis of the driving transistor DT can be reduced. Accordingly, on-bias stress can be defined as an operation to apply directly a suitable bias voltage (for example, V1=V1_H) to the driving transistor DT during non-light emission sections.

Also, as the sixth transistor T6 is turned on in the first bias section, the pixel electrode (or anode electrode) of the electroluminescent device ELD connected to the fifth node N5 is initialized to the second bias voltage V2. However, the gate electrodes of the fifth and sixth transistors T5 and T6 may be configured to receive separate scan signals and to be controlled independently, respectively. That is, it is not necessarily required to simultaneously apply the bias voltage to the source electrode of the driving transistor DT and the pixel electrode of the electroluminescent device ELD in the first bias section.

In FIG. 3C, the high second scan signal SC2(*n*) is input, and the first bias voltage V1 is changed from V1_H to V1_L. As the high second scan signal SC2(*n*) is input, the fifth and sixth transistors T5 and T6 are turned off.

Figure 3D:
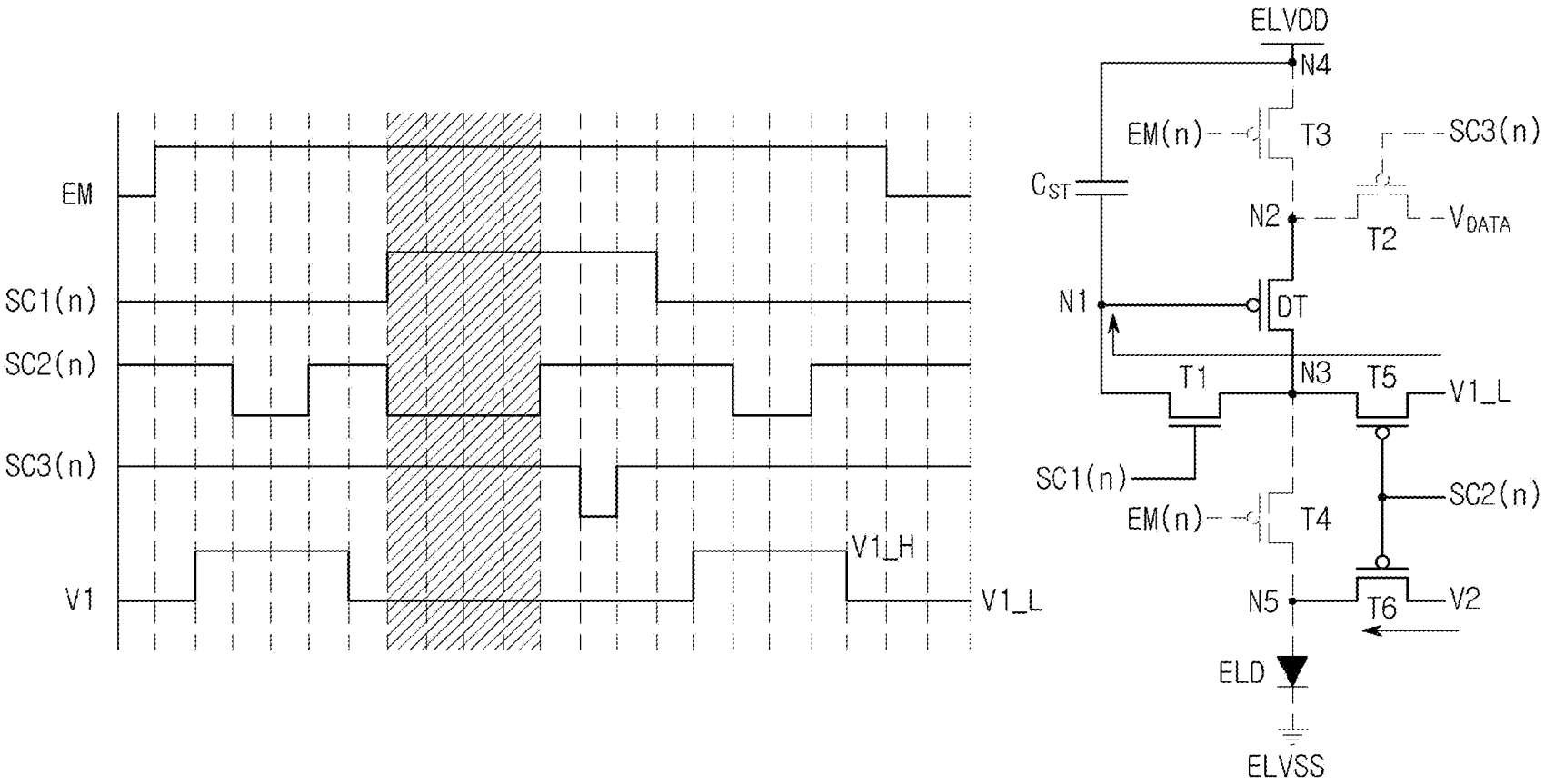

FIG. 3D shows the initialization section. In the initialization section, the voltage of the gate electrode of the driving transistor DT is initialized.

In FIG. 3D, the first scan signal SC1(*n*) represents a high voltage, and the first transistor T1 is turned on. The second scan signal SC2(*n*) represents a low voltage, and the fifth and sixth transistors T5 and T6 are turned on. As the first and fifth transistors T1 and T5 are turned on, the voltage of the gate electrode of the driving transistor DT connected to the first node N1 is initialized to the voltage V1_L. Also, as the sixth transistor T6 is turned on, the pixel electrode (or anode electrode) of the electroluminescent device ELD is initialized to the second bias voltage V2. However, as described above, the gate electrodes of the fifth and sixth transistors T5 and T6 may be configured to receive separate scan signals and to be controlled independently, respectively. That is, it is not necessarily required to simultaneously apply the bias voltage to the source electrode of the driving transistor DT and the pixel electrode of the electroluminescent device ELD in the first bias section.

Figure 3E:
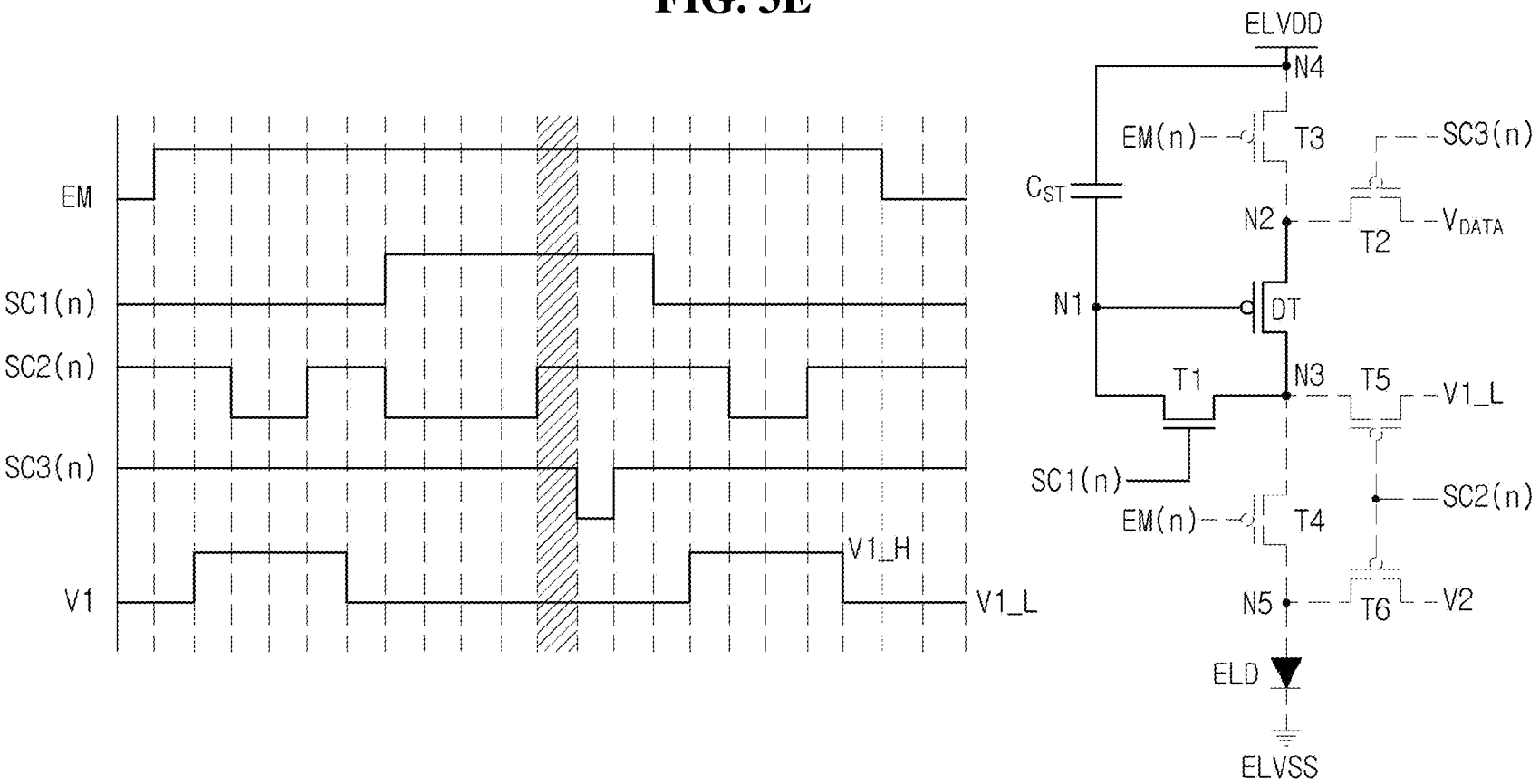
Figure 3F:
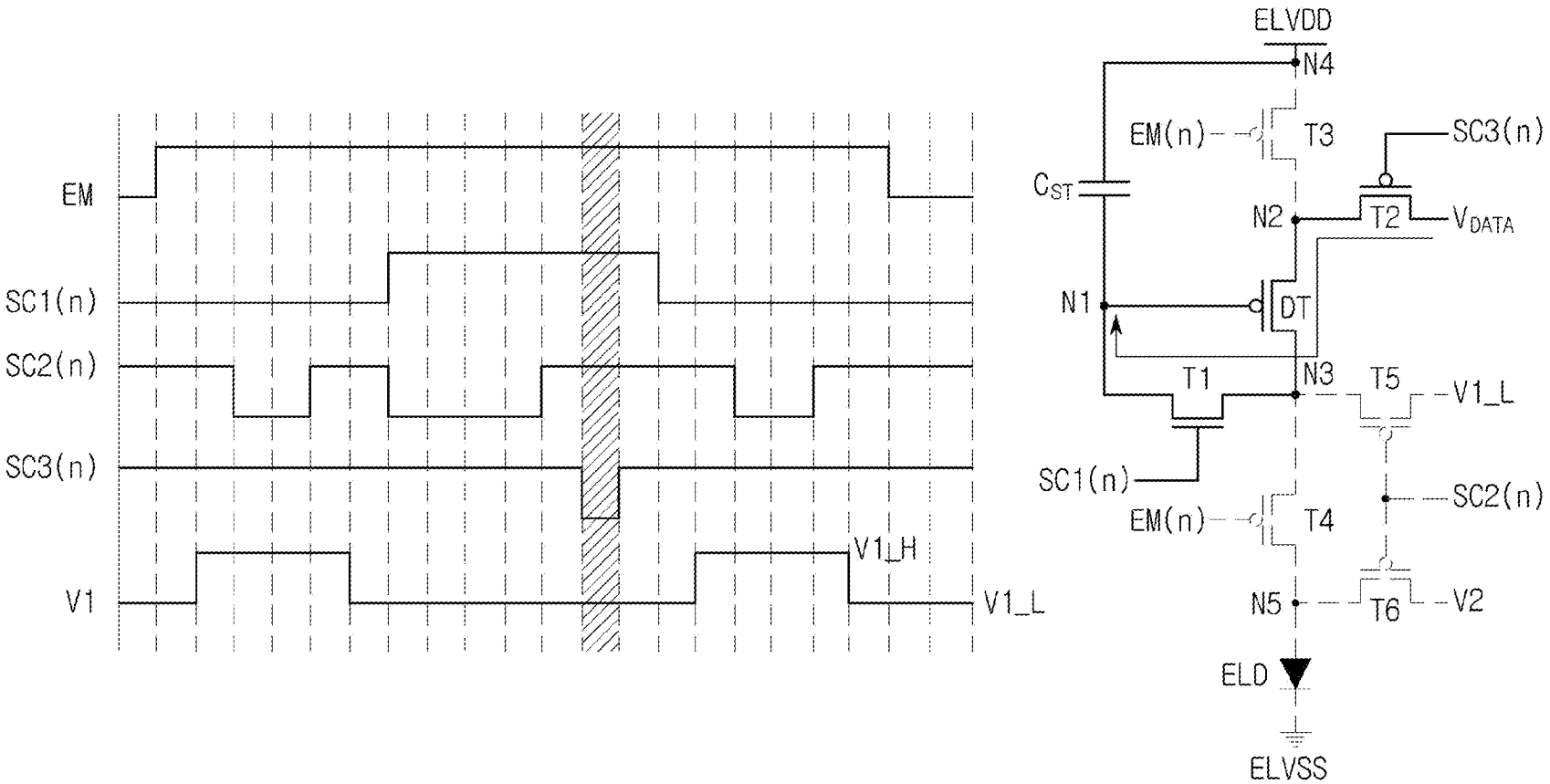
Figure 3G:
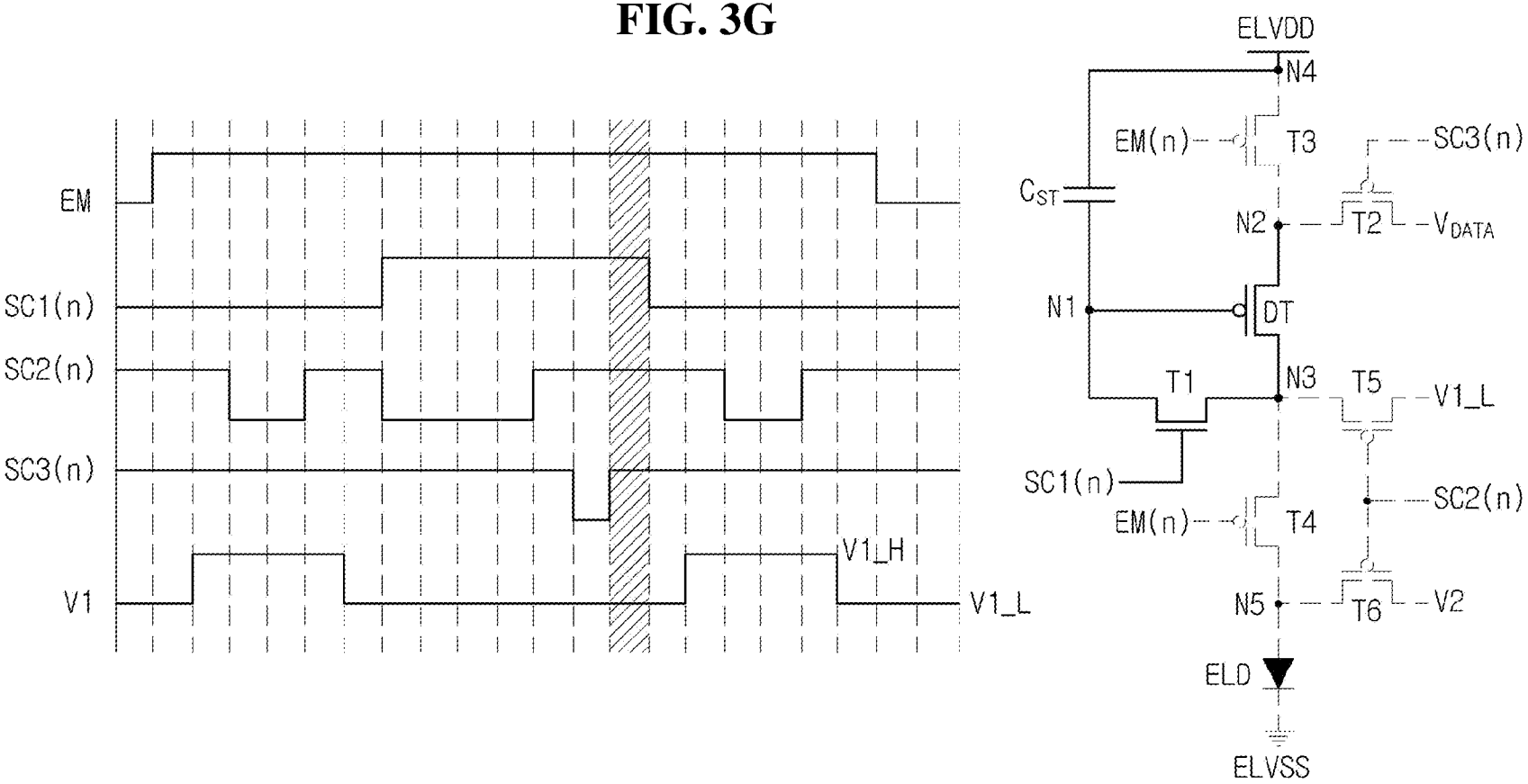

FIGS. 3E to 3G show sampling sections. In the sampling section, the data voltage and the threshold voltage Vth of the driving transistor DT are sampled and stored in the first node N1.

In FIG. 3E, the high second scan signal SC2(*n*) is input, and the fifth and sixth transistors T5 and T6 are turned off. The first transistor T1 maintains an on-state.

In FIG. 3F, the low third scan signal SC3(*n*) is input, and the second transistor T2 is turned on. As the second transistor T2 is turned on, the voltage of $V_{DATA}$(n) of the current frame n is applied to the source electrode of the driving transistor DT connected to the second node N2. Also, the first transistor T1 maintains an on-state. Since the driving transistor DT is diode-connected in the state where the first transistor T1 is turned on, the voltage of the gate electrode of the driving transistor DT connected to the first node N1 is $V_{DATA}$(n)−|Vth|. That is, the first transistor T1 is diode-connected between the first node N1 and the third node N3, thereby sampling the threshold voltage Vth of the driving transistor DT.

In FIG. 3G, the high third scan signal SC3(*n*) is input, and the second transistor T2 is turned off.

Figure 3H:
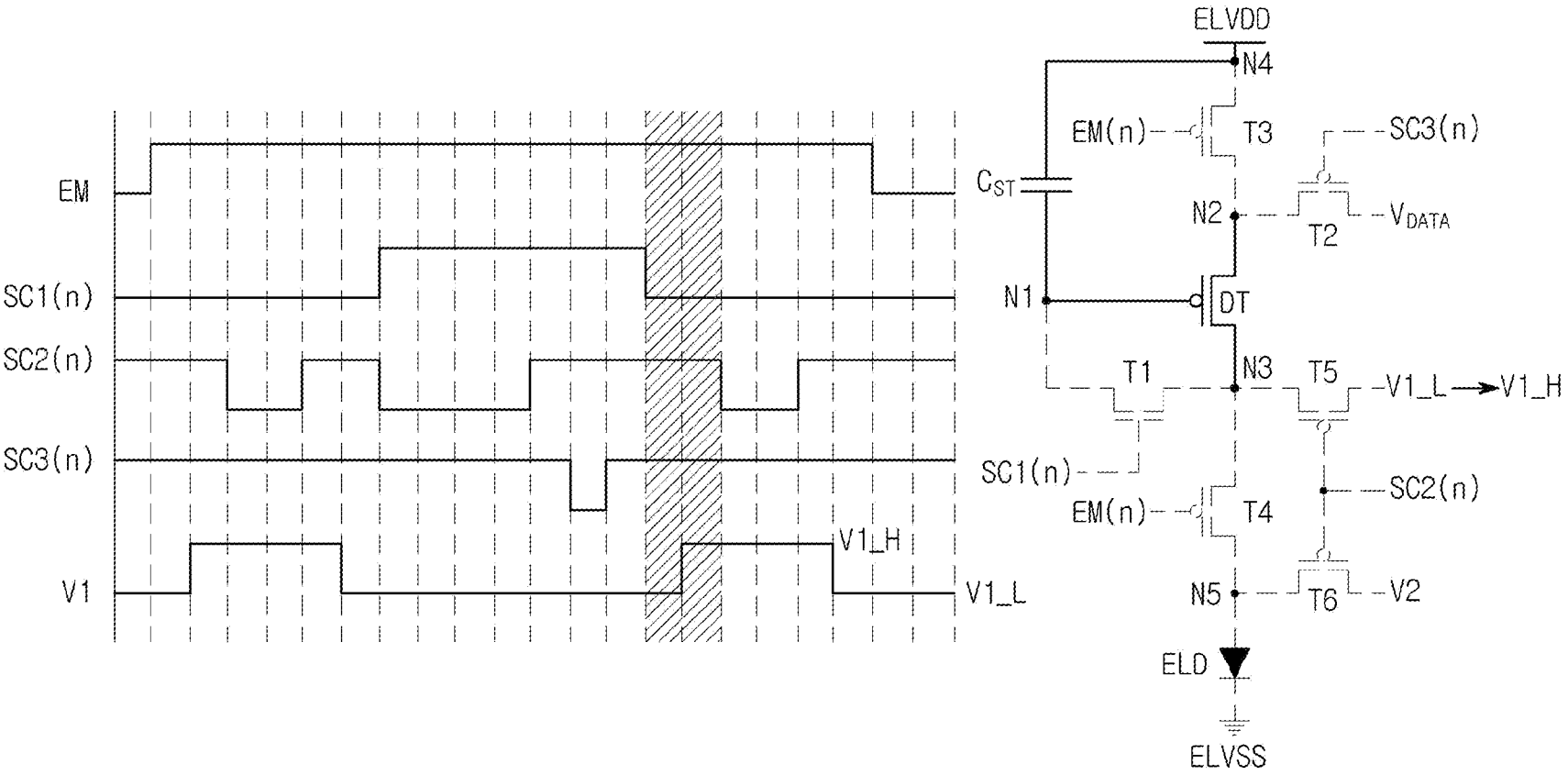
Figure 3I:
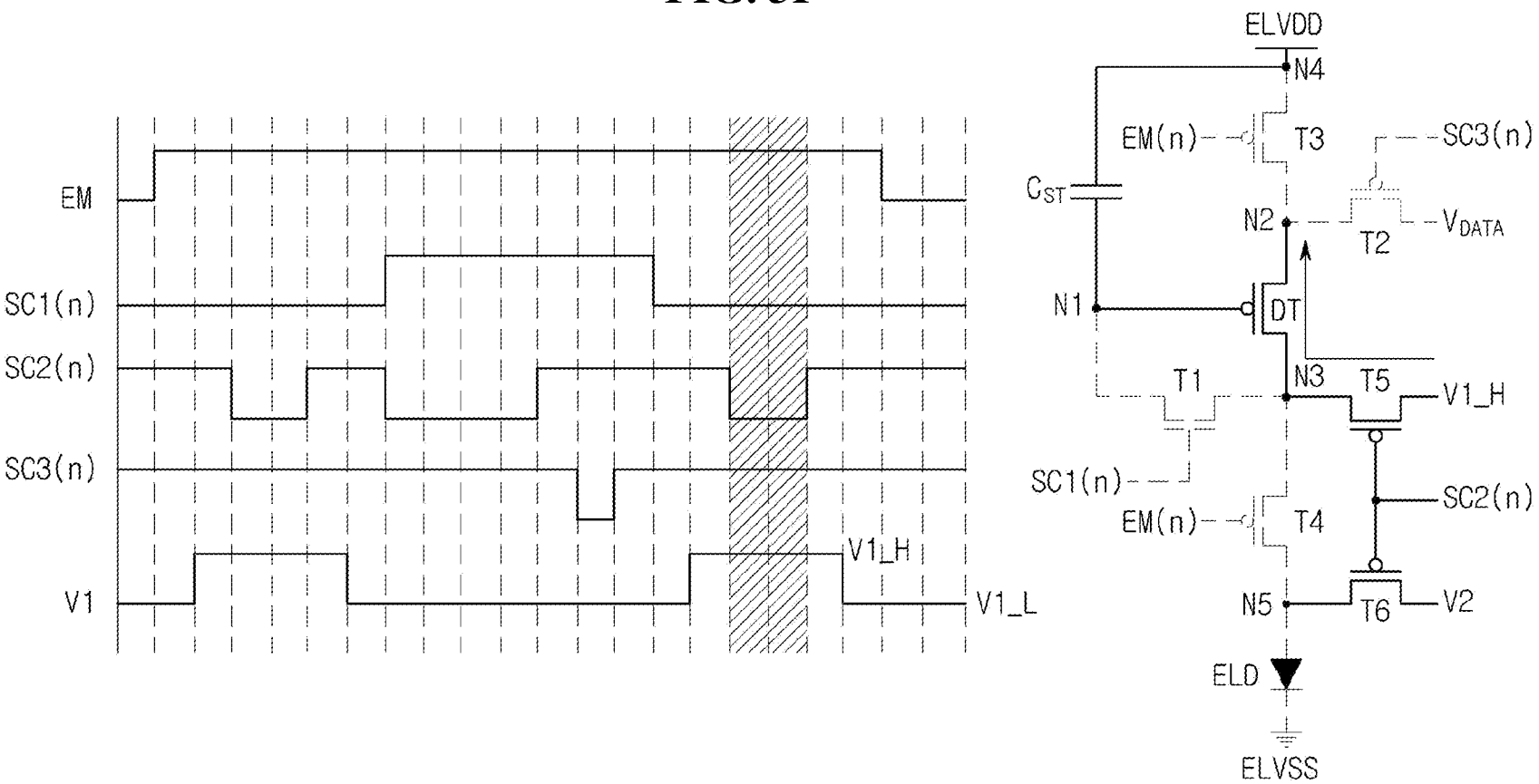
Figure 3J:
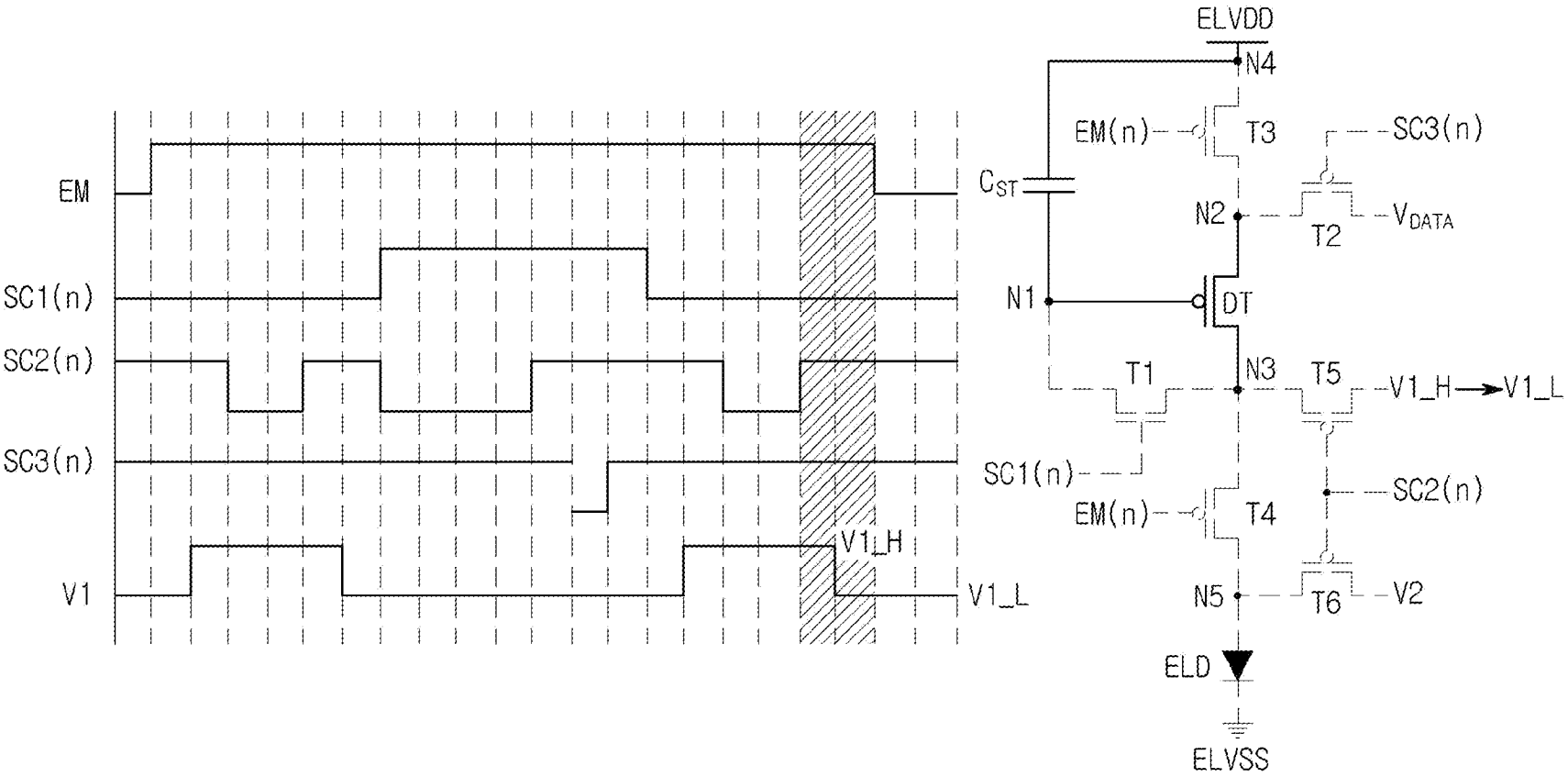

FIGS. 3H to 3J show a second bias section.

Since a driving waveform in the second bias section is the same as that of the first bias section, a detailed description thereof will be omitted.

In FIG. 3H, the first bias voltage V1 is changed from V1_L to V1_H.

In FIG. 3I, as the fifth transistor T5 is turned on, the voltage of the first electrode of the driving transistor DT connected to the second node N2 increases to the voltage V1_H. Here, the voltage Vgs between the gate and the source of the driving transistor DT is Vgs=$V_{DATA}$(n)−|Vth|−V1_H. That is, the driving transistor DT maintains a stronger saturation. Also, as the sixth transistor T6 is turned on, the pixel electrode (or anode electrode) of the electroluminescent device ELD is initialized to the second bias voltage V2. The voltage of the gate electrode of the driving transistor DT connected to the first node N1 maintains $V_{DATA}$(n)−|Vth|.

In FIG. 3J, the high second scan signal SC2(*n*) is input, and the first bias voltage V1 is changed from V1_H to V1_L. As the high second scan signal SC2(*n*) is input, the fifth and sixth transistors T5 and T6 are turned off. The voltage of the gate electrode of the driving transistor DT connected to the first node N1 maintains $V_{DATA}$(n)−|Vth|.

Figure 3K:
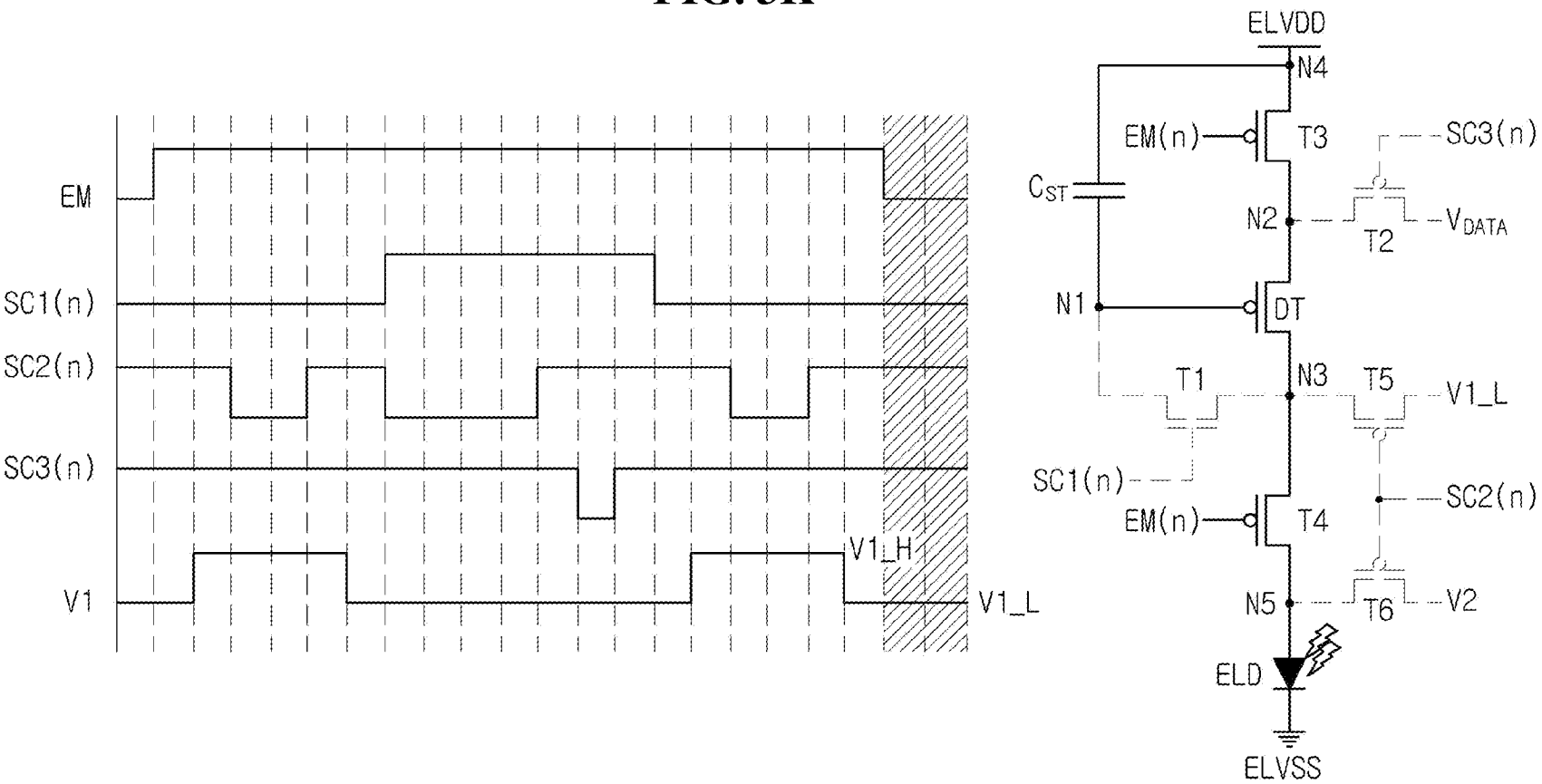

FIG. 3K shows the light emission section. In the light emission section, the sampled threshold voltage Vth is canceled and the electroluminescent device ELD is caused to emit light with a driving current corresponding to the sampled data voltage.

In FIG. 3K, the light emission signal EM represents a low voltage, and the third and fourth transistors T3 and T4 are turned on.

As the third transistor T3 is turned on, the first power supply voltage ELVDD connected to the fourth node N4 is applied to the source electrode of the driving transistor DT connected to the second node N2 through the third transistor T3. The driving current Id supplied by the driving transistor DT to the electroluminescent device ELD via the fourth transistor T4 becomes irrelevant to the value of the threshold voltage Vth of the driving transistor DT, so that the threshold voltage Vth of the driving transistor DT is compensated for and operated.

Next, the driving of the electroluminescent device and the pixel circuit of the hold frame will be described with reference to FIGS. 4A to 4C. The hold frame may include at least one bias section and the light emission section.

As described above, the refresh frame and the hold frame are different in that while, in the refresh frame, a new data voltage $V_{DATA}$ is charged and applied to the gate electrode of the driving transistor DT, in the hold frame, the data voltage $V_{DATA}$ of the previous frame is maintained and used. Therefore, unlike the refresh frame, the hold frame does not require the initialization section and the sampling section.

FIGS. 4A and 4B show the first and second bias sections, and FIG. 4C shows the light emission section.

In the operation of the hold frame, even one bias section may be sufficient. However, in this embodiment, for convenience of the driving circuit, the second scan signal SC2(*n*) is driven in the same manner as the second scan signal SC2(*n*) of the refresh frame, and thus, there are two bias sections.

The drive signal in the refresh frame described with reference to FIGS. 3A to 3K and the drive signal in the hold frame in FIGS. 4A to 4C are different due to the first and third scan signals SC1(*n*) and SC3(*n*). The initialization section and the sampling section are not required in the hold frame. Therefore, unlike the refresh frame, the first scan signal SC1(*n*) is always in a low state, and the third scan signal SC3(*n*) is always in a high state. That is, the first and second transistors T1 and T2 are always turned off.

Meanwhile, in a hold frame section, the data voltage $V_{DATA}$ of the previous frame is maintained and used as it is, and a new data voltage $V_{DATA}$ is not applied. Therefore, the data supply transistor that provides a data signal to the driving transistor maintains the off-state for a long time. Leakage current may be generated due to an electric potential difference between the source electrode and the drain electrode of the second transistor T2 (or the data supply transistor), during a section of time when the second transistor T2 (or the data supply transistor) maintains the off-state for a long time. The leakage current causes a change in a gate-source voltage difference of the driving transistor DT, and as a result, the driving current (Id) of the electroluminescent device ELD varies during the hold frame section, resulting in deterioration of an image quality.

Figure 5:
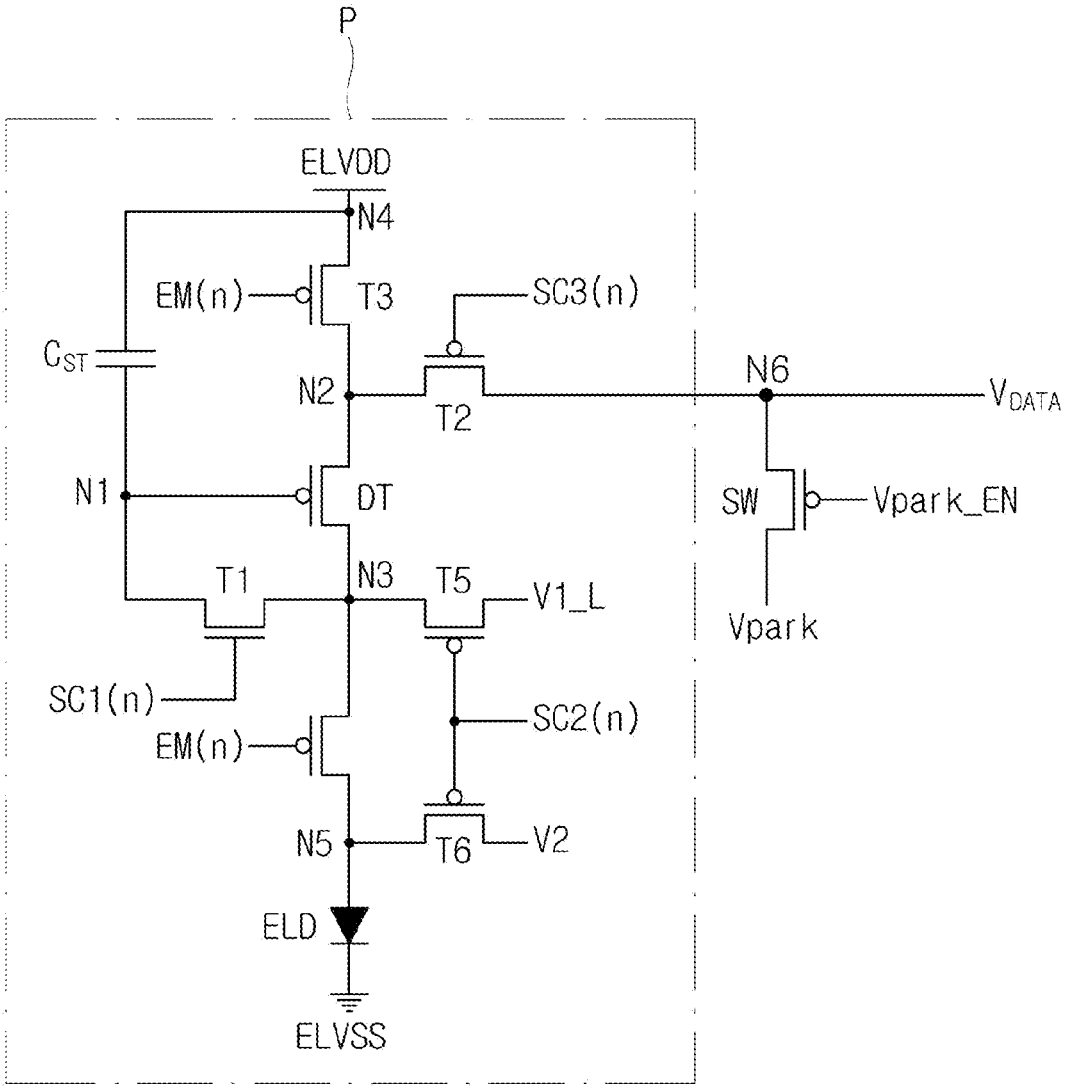
FIG. 5 is a circuit diagram showing another example of the pixel included in the display device according to the embodiment of the present invention.
Figure 6:
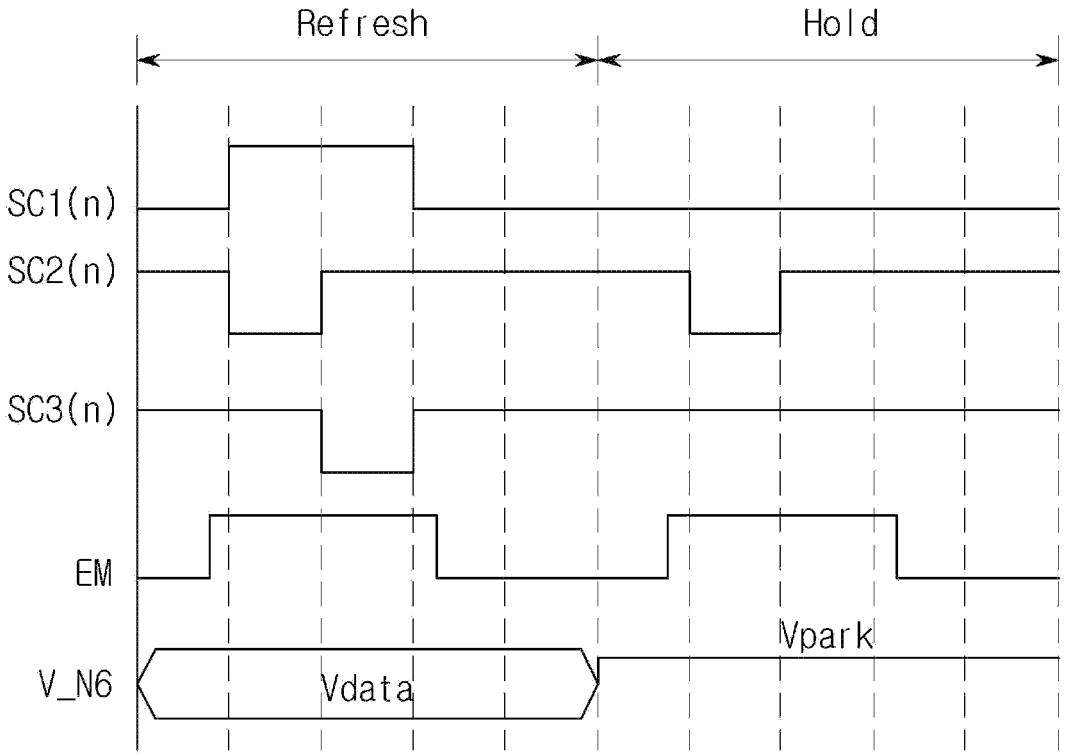
FIG. 6 shows driving waveforms in a refresh frame section and a hold frame section.

FIG. 5 is a circuit diagram showing another example of the pixel included in the display device according to the embodiment of the present invention. FIG. 6 shows driving waveforms in a refresh frame section and a hold frame section.

In FIG. 5, each pixel P may include the pixel circuit (PC) having the driving transistor DT and the electroluminescent device ELD connected to the pixel circuit (PC). Since the pixel P has been described with reference to FIG. 2, repetitive descriptions thereof will be omitted.

The second transistor T2 includes the first electrode connected to the data line DL, the second electrode connected to the second node N2, and the gate electrode receiving the third scan signal SC3(*n*). The second transistor T2 receives the data voltage $V_{DATA}$ from the data driver 140 connected to the data line DL and applies it to the second node N2.

The switching element SW may be composed of a transistor including the gate electrode to which a parking voltage enable signal Vpark_EN is applied, the first electrode to which a parking voltage (or protection voltage) Vpark is applied, and the second electrode connected to the data line. The switching element SW may be a PMOS transistor. The first electrode of the switching element SW may be a drain electrode, and the second electrode may be a source electrode. The parking voltage enable signal Vpark_EN for controlling on/off of the switching element SW may be supplied from the controller 120. The parking voltage Vpark may be supplied from the power supplier 160.

The power supplier 160 may generate the first and second power supply voltages ELVDD and ELVSS and the parking voltage Vpark. The power supplier 160 may supply the parking voltage Vpark to each pixel P during the hold frame. Leakage current can be prevented from occurring in the second transistor T2 (or the data supply transistor) which constitutes the pixel driving circuit (PC) of each pixel P by applying the parking voltage Vpark during the hold frame. As described above, since the previous data signal is maintained and used in the hold frame section, there is a problem that leakage current is generated due to an electric potential difference between the source electrode and the drain electrode of the second transistor T2 (or the data supply transistor). The driver according to the embodiment of the present disclosure supplies the parking voltage Vpark to the pixel P during the hold frame section, thereby preventing the driving current from changing due to the leakage current of the second transistor T2 (or the data supply transistor). As shown in FIG. 6, in the refresh frame section, a voltage V_N6 of a sixth node N6 is the data voltage Vdata supplied from the data driver, and in the hold frame section, the voltage V_N6 of the sixth node is the parking voltage Vpark supplied from the power supplier 160.

On the other hand, the power supplier 160 according to another embodiment may supply each pixel P with the parking voltage Vpark of which the magnitude is not fixed and is controlled based on the luminance value of an input image data.

Figure 7:
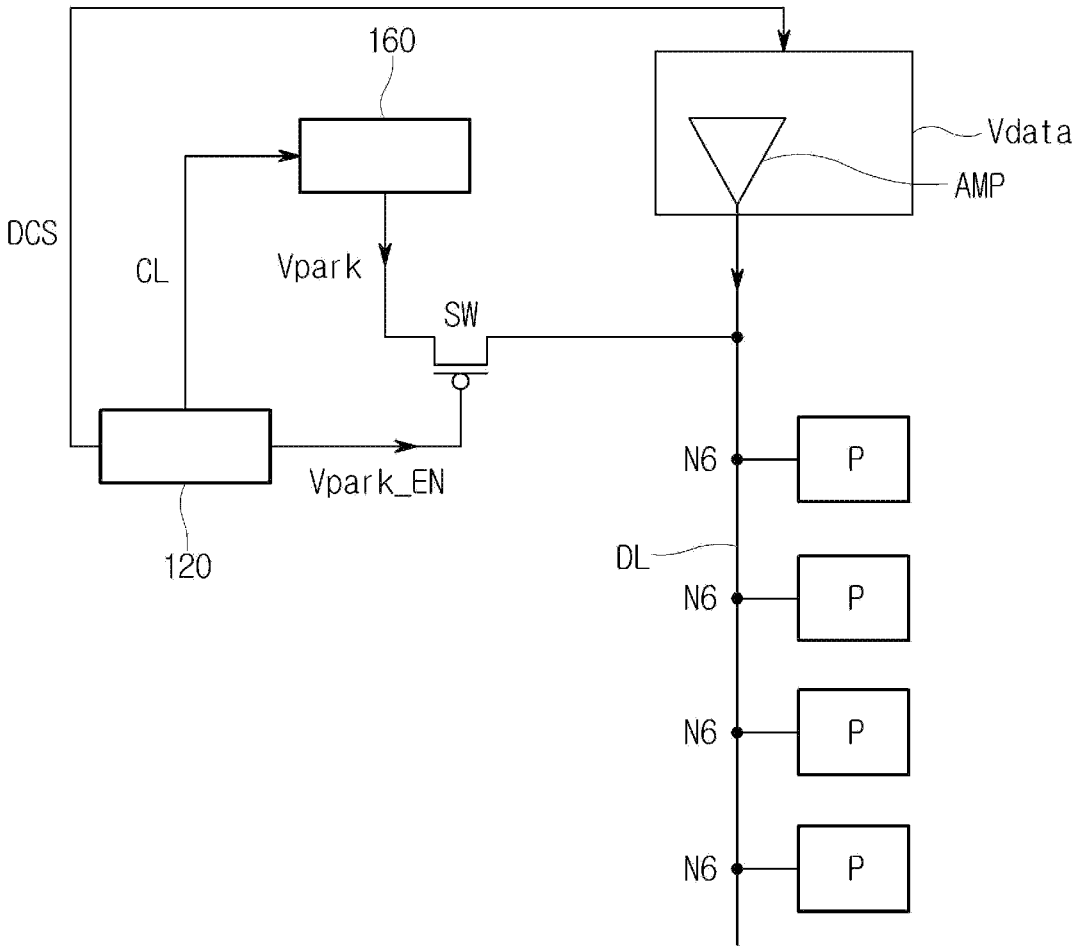
FIG. 7 is a view for describing a connection relationship between a controller, a power supplier, a data driver, and each pixel.

FIG. 7 is a view for describing a connection relationship between the controller, the power supplier, the data driver, and each pixel.

Each pixel P is connected to the data line and receives the data voltage or the parking voltage Vpark. The data driver may include a buffer AMP at an output terminal thereof. The data driver 140 converts the image data RGB into the data voltage Vdata in accordance with the data control signal DCS provided from the controller 120, and provides the converted data voltage Vdata to the pixel P through the data line DL.

The switching element SW may perform an on/off operation under the control of the controller 120. The controller 120 may apply the parking voltage enable signal Vpark_EN to the gate electrode of the switching element SW. The controller 120 may control the data driver to supply the data voltage to each pixel P through the data line in the refresh frame section. Also, the controller 120 may control the switching element SW in the hold frame section so that the power supplier 160 supplies the parking voltage Vpark to each pixel P through the data line.

The power supplier 160 according to the embodiment may supply each pixel P with the parking voltage Vpark of which the magnitude is not fixed and is controlled based on a current luminance (hereinafter, referred to as CL) output by the controller 120. The control signal of the controller 120 may be based on the luminance value of an input image data.

Figure 8:
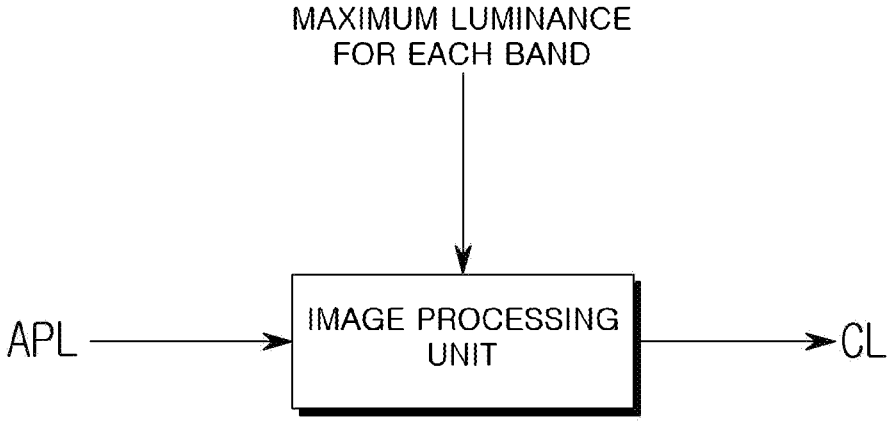
FIG. 8 is a block diagram of an image processing unit included in the controller.

FIG. 8 is a block diagram of an image processing unit included in the controller.

The controller 120 according to the embodiment may include the image processing unit.

The image processing unit may calculate the current luminance CL based on an average picture level APL of the input image and a maximum luminance for each band.

The purpose of the present disclosure is to prevent leakage current of the second transistor T2 (see FIG. 5) in the hold frame section. In order to prevent leakage current of the second transistor T2 (or the data supply transistor), the parking voltage Vpark is applied to the data line connected to the second transistor T2 (or the data supply transistor) in the hold frame section. The parking voltage Vpark is for preventing the leakage current from being generated by eliminating an electric potential difference between the first and second electrodes of the second transistor T2 (or the data supply transistor).

The voltage of the second node N2 connected to the second transistor T2 (or the data supply transistor) is affected by the first power supply voltage ELVDD. Also, the first power supply voltage ELVDD supplied to each pixel P may vary according to the amount of current (I) applied to the display panel. The first power voltage actually applied to each pixel P may be dropped and supplied in accordance with a resistance component (R) in the display panel. This voltage drop (V) is due to the resistance component in the display panel and is proportional to the amount of current applied to the display panel (V=I*R). Also, the amount of current applied to the display panel increases as a pixel data of the input image has a high gradation value or as the luminance of the input image increases. Therefore, the magnitude of the parking voltage Vpark is required to be controlled according to the luminance of the input image.

The image processing unit receives the pixel data (DATA) of the input image and calculates an average picture level APL of the input image for each frame. The average picture level APL may be calculated as a luminance average of the brightest color in one frame image data.

Specifically, the average picture level APL can be calculated by the Equation (1).

$$APL(\%) = \frac{\text{SUM } \{\text{Max}(R, G, B)/255\}}{\text{Total number of Pixels}} \times 100 \quad \text{Equation (1)}$$

Here, R indicates red data, G indicates green data, and B indicates blue data. Max (R, G, B) is the maximum value among R, G, and B, and SUM {Max (R, G, B)} is the sum of the maximum values among R, G, and B. An image with a large number of bright pixel data has a high average picture level APL. On the other hand, an image with a small number of bright pixel data has a low average picture level APL. When the pixel data is composed of 8 bits, a peak white gray level has a gradation value of 255.

Meanwhile, the maximum luminance of the display device may be set differently for each band.

For example, when the display device is a mobile device, the display device needs to brightly display outdoors, and in an indoor place that is darker than the outdoors, the display device does not need to display as brightly as the outdoors. Therefore, in the indoors, the display device can be set to display darker in order to reduce power consumption.

Alternatively, a user can display by controlling the luminance through the UI.

The maximum luminance of the display device may be set differently for each band by controlling the first power supply voltage ELVDD, by controlling a gamma compensation voltage in proportion to the luminance of a peak luminance control (PLC) curve, or by controlling the data gray level of the input image in proportion to the luminance of the PLC curve.

Here, when the maximum luminance of the display device is set differently for each band by controlling the first power supply voltage ELVDD, the voltage of the second node N2 connected to the second transistor T2 (or the data supply transistor) of FIG. 5 is changed. In the present specification, the parking voltage Vpark is applied to the data line connected to the second transistor T2 (or the data supply transistor) in order to prevent leakage current of the second transistor T2 (or the data supply transistor) in the hold frame section. Since it is intended to prevent the leakage current by eliminating the voltage difference between the first and second electrodes of the second transistor T2 (or the data supply transistor) in the hold frame section, the voltage of the second node N2 must be considered for the parking voltage Vpark. Also, when the maximum luminance of the display device is set differently for each band by controlling the first power supply voltage ELVDD, the first power supply voltage ELVDD varies for each band, and as a result, the voltage of the second node N2 also varies. Consequently, in order to prevent leakage current of the second transistor T2 (or the data supply transistor), the maximum luminance for each band needs to be reflected in the magnitude of the parking voltage Vpark.

The current luminance CL may be calculated by the Equation (2).

$$CL = BMB \times \left(\frac{APL}{255}\right)^g \quad \text{Equation (2)}$$

Here, BMB represents the maximum luminance for each band, and 255 represents the value of the peak white gray level when the pixel data is composed of 8 bits. "g" represents a gamma value, and a standard gamma value of 2.2 can be applied to "g".

Figure 9:
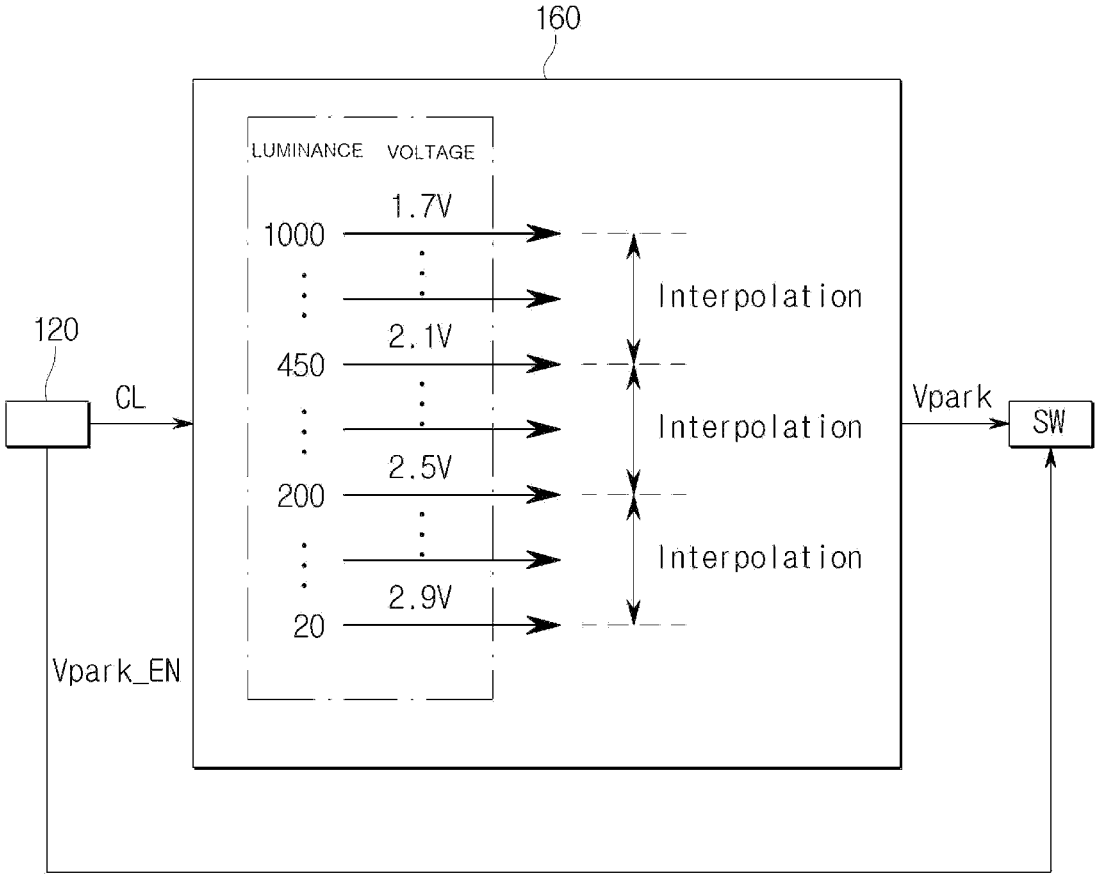
FIG. 9 is a view for describing a connection relationship between the controller, the power supplier, and a switching element.

FIG. 9 is a view for describing a connection relationship between the controller 120, the power supplier 160, and the switching element SW.

As described above, the controller 120 generates the current luminance CL and outputs it to the power supplier 160. The power supplier 160 supplies each pixel P with the parking voltage Vpark of which the magnitude has been controlled on the basis of the luminance. Also, the parking voltage enable signal Vpark_EN for controlling the on/off of the switching element SW configured to connect the power supplier 160 and the data line is output to the switching element SW by the controller 120.

The power supplier 160 may further include a register in which the parking voltage Vpark mapped to the current luminance CL is stored.

The mapping between the parking voltage Vpark and the current luminance CL received from the controller 120 may be summarized as shown in the following Table 1, and may be experimentally derived.

TABLE 1

| Current Luminance CL | Parking Voltage Vpark |
|---|---|
| 1000 | 1.7 V |
| 150 | 2.1 V |
| 200 | 2.5 V |
| 20 | 2.9 V |

When the current luminance CL input from the controller 120 does not match the current luminance stored in the register, that is to say, has a value between the mapping values, interpolation may be performed to output the parking voltage Vpark.

The present disclosure relates to the electroluminescent display device using the variable refresh rate (VRR) mode. According to the embodiment of the present disclosure, it is possible to prevent leakage current of the data supply transistor by adaptively controlling and supplying, on the basis of the luminance value of the input data, the parking voltage which is applied in order to prevent the leakage current of the data supply transistor.

Also, the display device according to the embodiment prevents the driving current of the electroluminescent device from changing during the hold frame section, so that there is no problem of image quality deterioration.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A display driver comprising:

a controller which provides a clock signal swinging between a high level and a low level during a refresh frame in which a data voltage is written in a pixel, and provides a clock signal having a direct current voltage during a hold frame in which the data voltage written in the pixel is maintained;

a data driver which supplies the data voltage to the pixel during the refresh frame in accordance with a data control signal of the controller; and a power supplier which supplies a parking voltage to the pixel during the hold frame, wherein the power supplier generates the parking voltage on the basis of a current luminance which the controller outputs, and wherein the controller outputs the current luminance on the basis of an average picture level of an input image.

2. The display driver of claim 1, wherein the controller comprises a maximum luminance for each band and outputs the current luminance.

3. The display driver of claim 2, wherein the controller sets the maximum luminance for each band, and the maximum luminance for each band is reflected in a magnitude of the parking voltage.

4. The display driver of claim 1, wherein the power supplier comprises a register in which the parking voltage mapped to the current luminance is stored.

5. The display driver of claim 1, wherein the controller includes an image processing unit which calculates the current luminance based on the average picture level of the input image and a maximum luminance for each band.

6. A display driver comprising:

a controller which provides a clock signal swinging between a high level and a low level during a refresh frame in which a data voltage is written in a pixel, and provides a clock signal having a direct current voltage during a hold frame in which the data voltage written in the pixel is maintained;

a data driver which supplies the data voltage to the pixel during the refresh frame in accordance with a data control signal of the controller; and a power supplier which supplies a parking voltage to the pixel during the hold frame, wherein the power supplier comprises a register in which the parking voltage mapped to a maximum luminance for each band is stored in advance.

7. A display driver comprising:

a controller which provides a clock signal swinging between a high level and a low level during a refresh frame in which a data voltage is written in a pixel, and provides a clock signal having a direct current voltage during a hold frame in which the data voltage written in the pixel is maintained;

a data driver which supplies the data voltage to the pixel during the refresh frame in accordance with a data control signal of the controller; and a power supplier which supplies a parking voltage to the pixel during the hold frame, wherein the parking voltage supplied by the power supplier has a magnitude which is not fixed and is controlled based on a luminance value of an input image.

8. A display device comprising:

a display panel which comprises an electroluminescent device and a pixel circuit connected to the electroluminescent device;

a gate driver which provides a gate signal to the display panel;

a data driver which supplies a data voltage to the display panel during a refresh frame;

a controller which provides the gate driver with a clock signal swinging between a high level and a low level during the refresh frame in which the data voltage is supplied to the display panel, and provides the gate driver with a clock signal having a direct current voltage during a hold frame in which the data voltage written in the pixel circuit is maintained; and a power supplier which supplies a parking voltage to the pixel circuit during the hold frame, wherein the power supplier generates the parking voltage on the basis of a current luminance which the controller outputs, and wherein the controller outputs the current luminance on the basis of an average picture level of an input image.

9. The display device of claim 8, wherein the pixel circuit comprises:

a driving transistor which has a first electrode, a second electrode, and a gate electrode, and supplies a driving current to the electroluminescent device; and a data supply transistor configured to connect a data line to which the data voltage or the parking voltage is applied and the first electrode or the second electrode of the driving transistor, in accordance with a scan signal supplied from the controller.

10. The display device of claim 9, wherein the controller supplies the scan signal such that the data supply transistor performs an off-operation during the hold frame.

11. The display device of claim 9, further comprising a switching element (SW) which is configured to connect the power supplier and the data line in accordance with a parking voltage enable signal (Vpark_EN) of the controller.

12. The display device of claim 11, wherein the controller outputs the parking voltage enable signal (Vpark_EN) such that the switching element (SW) performs an on-operation during the hold frame.

13. The display device of claim 9, wherein the pixel circuit further comprises a compensation transistor which is configured to connect the first electrode or the second electrode and the gate electrode of the driving transistor.

14. The display device of claim 8, wherein the controller comprises a maximum luminance for each band and outputs the current luminance.

15. The display device of claim 14, wherein the controller sets the maximum luminance for each band, and the maximum luminance for each band is reflected in a magnitude of the parking voltage.

16. The display device of claim 8, wherein the power supplier comprises a register in which the parking voltage mapped to the current luminance is stored.

17. The display device of claim 8, wherein the controller includes an image processing unit which calculates the current luminance based on the average picture level of the input image and a maximum luminance for each band.

18. A display device comprising:

a display panel which comprises an electroluminescent device and a pixel circuit connected to the electroluminescent device;

a gate driver which provides a gate signal to the display panel;

a data driver which supplies a data voltage to the display panel during a refresh frame;

a controller which provides the gate driver with a clock signal swinging between a high level and a low level during the refresh frame in which the data voltage is supplied to the display panel, and provides the gate driver with a clock signal having a direct current voltage during a hold frame in which the data voltage written in the pixel circuit is maintained; and a power supplier which supplies a parking voltage to the pixel circuit during the hold frame, wherein the power supplier comprises a register in which the parking voltage mapped to a maximum luminance for each band is stored in advance.

19. A display device comprising:

a display panel which comprises an electroluminescent device and a pixel circuit connected to the electroluminescent device;

a gate driver which provides a gate signal to the display panel;

a data driver which supplies a data voltage to the display panel during a refresh frame;

a controller which provides the gate driver with a clock signal swinging between a high level and a low level during the refresh frame in which the data voltage is supplied to the display panel, and provides the gate driver with a clock signal having a direct current voltage during a hold frame in which the data voltage written in the pixel circuit is maintained; and a power supplier which supplies a parking voltage to the pixel circuit during the hold frame, wherein the parking voltage supplied by the power supplier has a magnitude which is not fixed and is controlled based on a luminance value of an input image.

* * * * *